US006748631B2

(12) United States Patent
Iguchi et al.

(10) Patent No.: US 6,748,631 B2
(45) Date of Patent: Jun. 15, 2004

(54) HINGE ASSEMBLY AND WRIST MOUNTING-TYPE ELECTRONIC APPARATUS UTILIZING HINGE ASSEMBLY

(75) Inventors: Katsunobu Iguchi, Chiba (JP); Dai Terasawa, Chiba (JP); Nobuhide Matsumoto, Chiba (JP); Yoshinori Bito, Chiba (JP); Takashi Ito, Chiba (JP); Haruo Hashimoto, Chiba (JP); Hiroshi Odagiri, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/015,403

(22) Filed: Dec. 12, 2001

(65) Prior Publication Data

US 2002/0104200 A1 Aug. 8, 2002

(30) Foreign Application Priority Data

Dec. 28, 2002 (JP) ..... 2000-400162

(51) Int. Cl.[7] ..... A44B 21/00

(52) U.S. Cl. ..... 24/265 WS; 24/265 R; 16/277; 368/313

(58) Field of Search ..... 24/265 WS, 265 B, 24/265 R; 224/174; 16/277, 286, 295; 368/313, 62, 88, 276, 281; 63/3, 12

(56) References Cited

U.S. PATENT DOCUMENTS

| | | | | |
|---|---|---|---|---|
| 5,235,560 A | 8/1993 | Seager | ..... | 368/10 |
| 5,260,915 A | 11/1993 | Houlihan | ..... | 368/10 |

FOREIGN PATENT DOCUMENTS

| | | |
|---|---|---|
| CH | 0664663 | 3/1988 |
| CH | 0677722 | 6/1991 |

*Primary Examiner*—Anthony Knight
*Assistant Examiner*—Andre' L. Jackson
(74) *Attorney, Agent, or Firm*—Adams & Wilks

(57) ABSTRACT

To provide a wrist mounting type electronic apparatus facilitating attachment and detachment thereof. The wrist mounting type electronic apparatus is constituted by a main body bent substantially in an L-like shape and straps comprising a hard material. An inserting portion is provided at a front end of the strap on one side and is inserted into an inserted portion of the pivotable strap on other side. The inserted portion is penetrated with a bar member which is engaged with a small diameter hole of the inserting portion. Thereby, the wrist mounting type electronic apparatus can be mounted to the wrist. A hinge of the strap is provided with a coil spring and a state of opening the strap relative to a cabinet of the main body is maintained so far as the strap is not engaged.

31 Claims, 16 Drawing Sheets

FIG. 4A
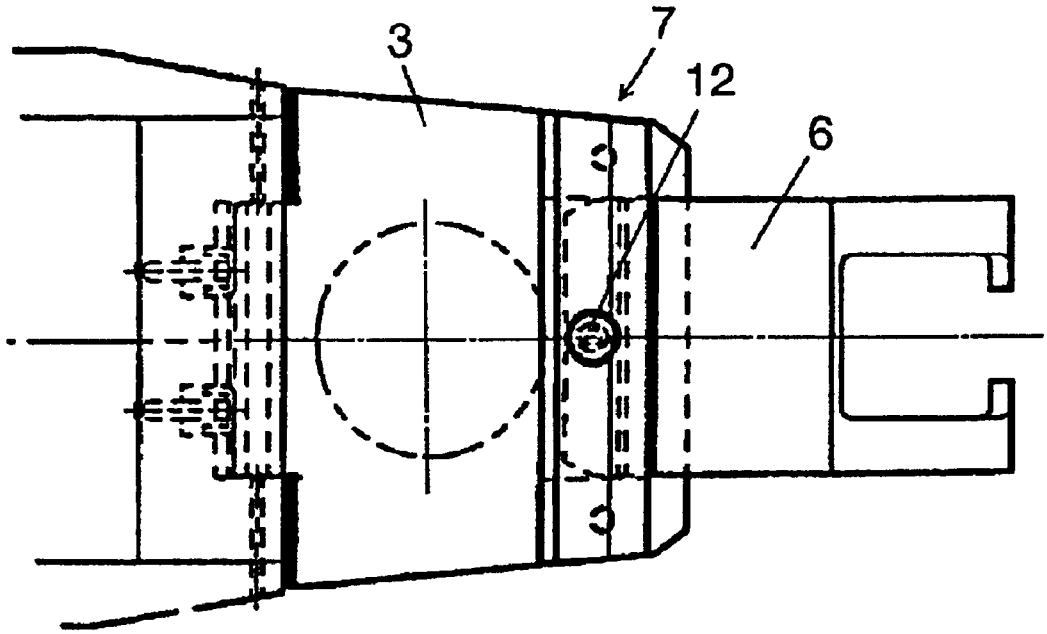
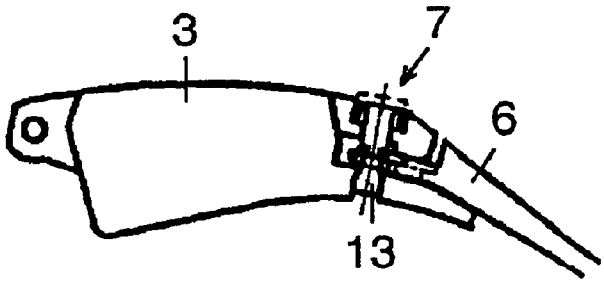
FIG. 4B

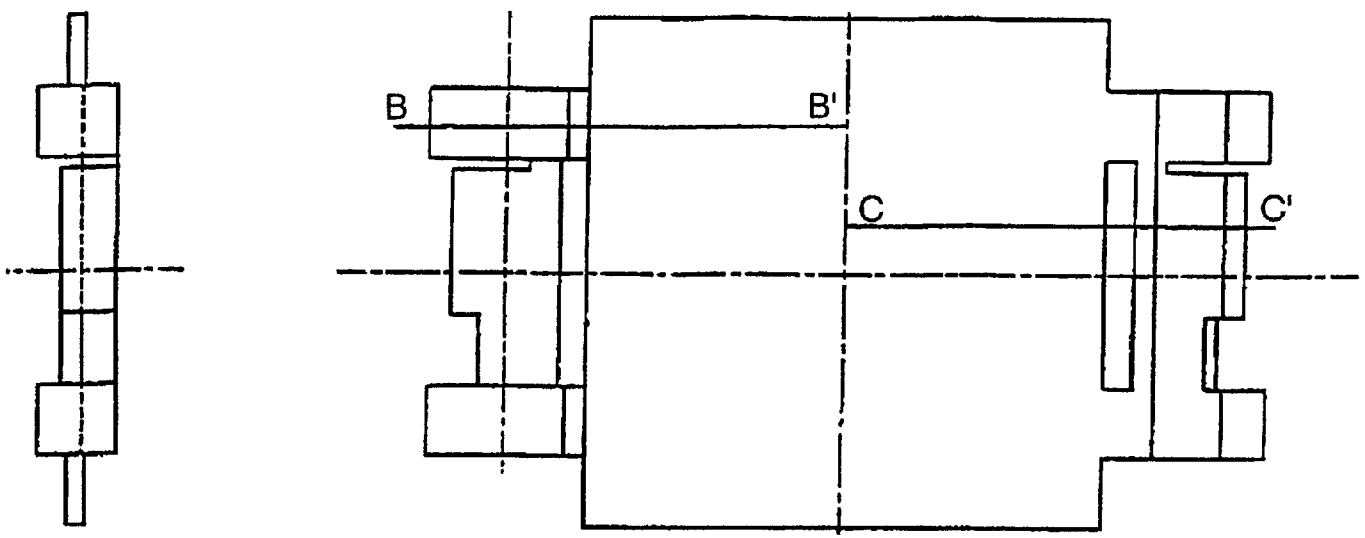
FIG. 11A
FIG. 11B
A DIRECTION SIDE VIEW
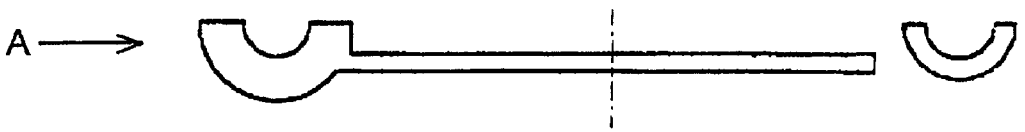
FIG. 11C
B - B' SECTIONAL VIEW
FIG. 11D
C-C' SECTIONAL VIEW

-X-O SECTIONAL VIEW

B-B' SECTIONAL VIEW

A DIRECTION SIDE VIEW

C-C' SECTIONAL VIEW

D-D' SECTIONAL VIEW

FIG. 13A
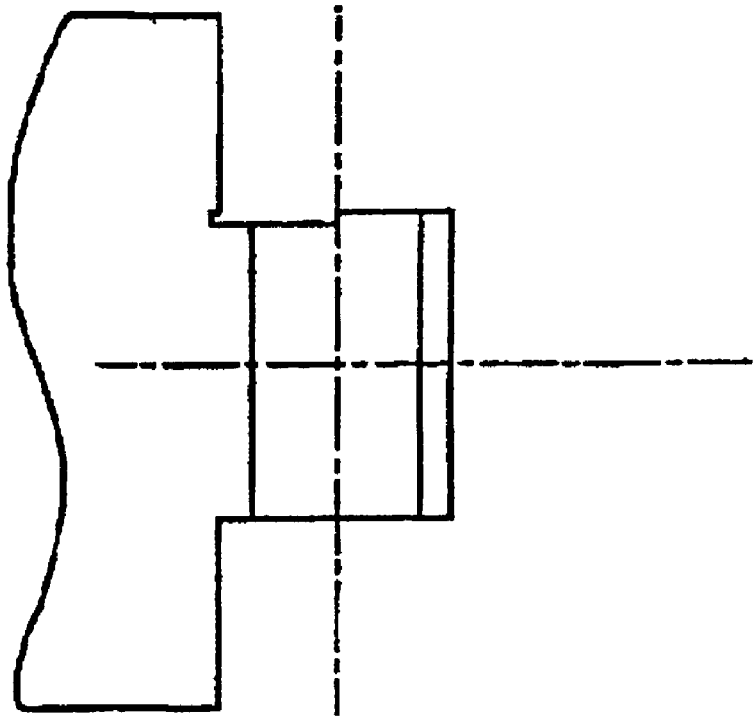
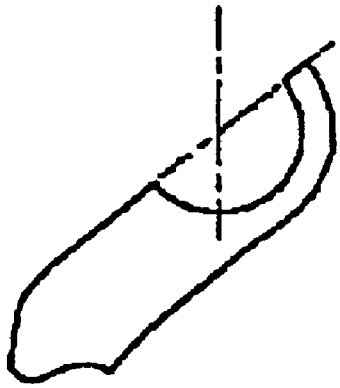
FIG. 13B

HINGE ASSEMBLY AND WRIST MOUNTING-TYPE ELECTRONIC APPARATUS UTILIZING HINGE ASSEMBLY

BACKGROUND OF THE INVENTION

1. Field of the Invention

The present invention relates to a hinge assembly and to wrist mounting-type electronic apparatus mounted on the wrist and utilizing the hinge assembly.

2. Description of the Prior Art

FIG. 18 is a constitution view showing a mounting member of a conventional wrist mounting type electronic apparatus 110. According to the wrist mounting type electronic apparatus 110, timepiece, computer, communication apparatus or the like is constituted by an electronic circuit to thereby downsize the wrist mounting type electronic apparatus to be able to be mounted on the wrist. Such a wrist mounting type electronic apparatus 110 is constituted by a main body 111 for executing a function provided thereby and a mounting member 112 for mounting the electronic apparatus on the wrist.

The mounting member 112 shown in the drawing is pivoted centering on a hinge 113 having a coupling portion coupled with the main body 111, thereby enabling mounting and dismounting on and from the wrist. An end portion of the mounting member 112 on a side opposed to the hinge 113, is provided with an engaging portion 114 for maintaining a state of being mounted onto the wrist. The engaging portion 114 is of a type of inserting a sheet metal member 116 substantially in a shape of check mark the width of which can be changed by elastic deformation, into an insertion slot 115 having a narrow opening.

The sheet metal member 116 substantially in the shape of the check mark, is formed by a shape in which a front end thereof is bent to fold in an acute angle and when the sheet metal member 116 is pressed to the insertion slot 115, the sheet metal member 116 is elastically deformed to contract to the width of the opening by following walls of the opening of the insertion slot 115. The sheet metal member 116 substantially in the shape of the check mark, is reduced in the width by the elastic deformation and passes through the insertion slot 115. After passing therethrough, the sheet metal member 116 elastically recovers to the original width in a space at inside of the insertion slot 115 and is prevented from being drawn therefrom. The space is provided with an attachment and detachment window 117 communicating with outside and when the sheet metal member 116 in the shape of the check mark is pressed from outside of the attachment and detachment window 117 to constitute a width the same as that of the width of the opening, the mounting member is drawn again from the insertion slot 115.

However, according to the conventional wrist mounting type electronic apparatus, opening and closing operation is carried out by utilizing a self weight thereof and accordingly, there poses a problem that the wrist mounting type electronic apparatus is difficult to open unless the position of the hinge is not pertinent. In this case, the mounting member must be opened and closed by a human hand and attached and detached to and from the wrist, which is inconvenient. Further, the mounting member is provided with a property that when the mounting member is mounted to the wrist or the like, the opened mounting member is fluctuated and accordingly, the mounting member is difficult to mount thereon.

SUMMARY OF THE INVENTION

Hence, the invention has been carried out in view of the above described and it is an object thereof to provide a hinge assembly and a wrist mounting-type electronic apparatus utilizing the hinge assembly and which can attach and detach a mounting member by a simple operation and is not fluctuated even in an opened state thereof.

In order to achieve the above-described object, according to the invention, there is provided a wrist mounting type electronic apparatus comprising a strap formed of a hard material, a hinge attached to a coupling portion of the strap and a cabinet of a main body and urged by a spring in a direction of opening the strap relative to the cabinet of the main body, a push button provided at the cabinet and engaging means engaged in a state of mounting the strap onto a wrist and disengaged by the push button.

The wrist mounting type electronic apparatus is constituted by the main body and the strap. According to the invention, there is provided the engaging means for mounting the strap of the hard material around the wrist. The engaging means may be constituted by insertion engagement for inserting a shaft into a hole by utilizing a difference in a thickness of the shaft, recess and projection engagement for making a groove catch a biting piece, or latch engagement for fixing a pivotal movement portion by a latch. Further, a position of providing the engaging means may be disposed at an end portion of the cabinet of the main body or the coupling portion of the straps. The push button provided at the cabinet of the main body is provided such that the engaging means is disengaged by pressing the push button. Further, a number of providing the push button is not limited to one. With regard to connection of the push button with the engaging means, the insertion can mechanically be disengaged, the biting to the groove can be disengaged or the latch can be disengaged in accordance with the engaging means. When the engaging means is disengaged, the strap is opened by the hinge urged by the spring and the wrist mounting type electronic apparatus can promptly be disengaged from the wrist.

Next, according to the invention, there is provided a wrist mounting type electronic apparatus comprising a first strap having an inserting portion at a front end thereof and rotatably supported by a main body, a second strap having an inserted portion inserted by the inserting portion at a front end thereof and rotatably supported by the main body, and a button for fixing the inserting portion to the inserted portion and releasing the inserted portion from the inserting portion. By providing the button for fixing and releasing the inserting portion and the inserted portion, the wrist mounting type electronic apparatus can easily be attached and detached to and from the wrist.

Next, according to the invention, there is provided the wrist mounting type electronic apparatus, further comprising a spring for urging at least one of the first strap and the second strap in an opening direction. By urging the strap by the spring, the strap can easily be disengaged from the wrist.

Next, according to the invention, there is provided the wrist mounting type electronic apparatus, wherein the inserting portion includes a groove provided on an inner side of an outer configuration thereof and a hole larger than the groove at a terminal end of the groove, and the inserted portion is provided with the button having a shaft in a taper shape and the shaft is coaxial with a center of the hole. By engaging the hole of the inserting portion and the shaft of the button, when the button is pushed, a portion of the shaft having a shaft diameter smaller than the diameter of the hole is moved from the hole, the inserting portion and the inserted portion are released and therefore, the wrist mounting type electronic apparatus can easily be disengaged from the wrist.

Further, next, according to the invention, there is provided a wrist mounting type electronic apparatus characterized in comprising a strap coupled to a hinge urged by a spring in an opening direction, an inserting portion constituting a flat portion provided at an edge portion of the strap on a side opposed to the hinge, having a small diameter hole and having a groove communicating with the small diameter hole from the edge portion by a width smaller than the small diameter, an inserted portion provided at a cabinet and having a slot portion slightly higher than the inserting portion, and a rod member extended from a push button attached to the inserted portion, having a shape connecting a shaft A having a diameter substantially the same as the diameter of the hole and a shaft B having a diameter smaller than a width of the groove by a taper a diameter of which is reduced toward a side of the push button and held by a spring to expose the shaft A and the taper portion to the slot when the push button is not pressed and expose the shaft B to the engaging slot when the push button is pressed.

The spring for urging the strap in the opening direction may be constituted by providing one end of a coil spring to a side of the cabinet and other end thereof to the strap or end portions of a leaf spring may be constituted similarly. Thereby, so far as the strap is not engaged, the strap maintains an opened state relative to the cabinet of the main body. The groove provided at the flat portion of the inserting portion passes the bar member having the diameter smaller than the width of the groove. After passing therethrough, the diameter of the bar member is increased and therefore the bar member is prevented from reversely returning from the groove. At this occasion, the bar member stays in the small diameter hole communicating with the groove.

The inserting portion is inserted into the slot portion of the inserted portion to which the bar member extended from the push button is exposed. When the push button is not pressed, the bar member is held by the spring such that the shaft A and the taper portion are exposed to the slot. Further, when the push button is pressed, the bar member exposes the shaft B to the slot. When the inserting portion inserted into the slot is brought into contact with the taper portion, the inserting portion pushes down the bar member and exposes the shaft B and makes the shaft B pass through the groove. After passing therethrough, the bar member is pushed back by the spring, the shaft A is fitted to the small diameter hole and the inserting portion is prevented from drawing from the slot portion easily.

Next, according to the invention, there is provided the wrist mounting type electronic apparatus, wherein the inserted portion is provided at a strap D coupled to an end portion of a main body of the wrist mounting type electronic apparatus via a hinge on a side opposed to the strap C. According to the invention, the inserting portion of the strap is engaged with the inserted portion similar to the above-described. According to the invention, the straps C and D are provided on both sides of the main body of the wrist mounting type electronic apparatus via hinges. Further, the inserted portion is provided at the strap D and accordingly, the straps are engaged with each other. When the engagement is disengaged, there can be constituted a state in which the straps C and D are opened on the both sides of the main body.

Next, according to the invention, there is provided the wrist mounting type electronic apparatus, wherein one face E forming the hinge is combined with a flat face and a curved face and other face F is provided with a press pin straightly moved by a spring for pressing the face E. When the face E constituting a face of a counter side of the hinge is the curved face, the press pin provided at the face F and moving straightly, is not caught thereby, makes pivotal movement smooth and also prevents play. Further, when the face E is the flat face, the strap coupled to the hinge at the angle is difficult to rotate. Thereby, the strap settles excellently at a convenient position.

Further, next, according to the invention, there is provided a wrist mounting type electronic apparatus comprising a strap coupled to a hinge urged by a spring in an opening direction, a latch urged to an opening side by a spring at an inner portion of a hole A provided at one hinge piece constituting the hinge, a hole B provided at a hinge piece opposed to the hole A for fitting the latch, and a push out bar integral with a push button projected to a surface of a cabinet, movable upwardly and downwardly from a vicinity of a bottom of the hole B to an opening portion thereof and held at the vicinity of the bottom by a spring when the push button is not pressed.

The spring for urging the strap in an opening direction may be provided with one end of a coil spring at a side of the cabinet and other end at the strap or end portions of a leaf spring may be constituted similarly. Thereby, so far as the strap is not engaged, the strap maintains an opened state relative to the cabinet of the main body. The hinge is constituted by constituting a pivotal movement pair by the two hinge pieces. When the latch urged to the opening side of the hole A is fitted to the hole B, the strap is fixed. The push out bar serves to push out the latch fitted into the hole B. When the latch is pushed out from the hole B, the strap is made pivotable and is brought into an opened state relative to the main body of the cabinet by being urged by the spring. Further, a number of the strap coupled by the hinge may be one or may be two.

Next, according to the invention, there is provided a wrist mounting type electronic apparatus comprising a strap coupled to a hinge urged by a spring in an opening direction and having a structure of sliding a shaft portion and a cover portion covering the shaft portion in pivotal movement thereof, a groove provided at a portion of the shaft portion, and a bite bar provided in a shape of a seesaw at a window portion communicating a surface of the cover portion and the shaft portion with a pin as a fulcrum, urged by a spring in a direction in which a projection bites the groove and disengaged from biting the groove by pushing an end portion thereof on a side opposed to the projection.

The hinge according to the invention is provided with a structure in which the two hinge pieces are pivoted relative to each other. There is used recess and projection fitting or a combination of the shaft portion and the cover portion covering the shaft portion in the pivoting structure. A window portion is provided at the surface of the cover portion and the shaft portion is exposed there from. The bite bar is provided at the window portion and the projection is urged by the spring in the direction of biting the groove of the shaft portion. Therefore, when there is not the groove at the shaft portion, the projection does not bite the groove and the hinge is pivoted freely. When the strap is pivoted and an angle of exposing the groove to the window portion is constituted, the projection of the bite bar bites the groove and pivotal movement of the strap is fixed.

When the end portion on the side opposed to the projection of the bite bar is pushed, since the bite bar is provided in the shape of the seesaw with the pin as the fulcrum, the projection is disengaged from the groove and the strap is pivoted freely. The strap is urged by the spring and therefore, when the strap is pivoted freely, the strap maintains an opened state relative to the main body of the wrist mounting type electronic apparatus. Further, the window portion provided with the bite bar may be disposed at the cabinet of the main body of the wrist mounting type electronic apparatus or may be disposed at the strap portion.

Next, according to the invention, there is provided a wrist mounting type electronic apparatus comprising a strap coupled to a hinge urged by a spring in an opening direction, a latch provided at an inner hole of a projected portion constituting the hinge by being urged by a spring in a direction of jumping out in an axial direction from a side face of the inner hole, pivoted along with the projected portion by being bound in pivotal movement thereof by a combination with a shape of the inner hole and provided with a shape of a side face constituting a same direction only by a single angle with a recessed side of the hinge as a reference in a pivotal movement range of the strap, a latch receive bound in pivotal movement thereof by a combination with a shape of an inner hole provided at the recessed portion of the hinge and provided with a shape of a side face fitted to the latch when the projected portion constitutes the single angle, and a push button a shaft integral therewith of which penetrates the latch receive, pushing the fitted latch to return to the inner hole of the projected portion by being pushed and projected to prevent from disengaging and dropping from a side face of the recessed portion.

The latch is provided at the inner hole of the projected portion constituting the hinge. The inner hole is not constituted by a simple cavity of a cylinder but formed with a groove or a projection. By forming a groove or a projection in conformity therewith also at the latch, the latch is bound in pivotal movement thereof and pivoted along with the projected portion. Further, the latch is urged by the spring in the direction of jumping out in the axial direction from the side face of the inner hole. Meanwhile, similar to the latch, the latch receive is bound in pivotal movement thereof by the combination with the shape of the inner hole provided at the recessed portion of the hinge. The latch is provided with the shape of the side face constituting the same direction only by the single angle with a recessed side of the hinge as reference in a pivotal movement range of the strap.

Therefore, the shape of the side face of the latch receive is determined such that the latch is fitted therewith at a desired angle. Further, when the fitting is carried out, the strap is fixed at the angle. The shaft integral with the push button serves to push back the latch fitted by pressing the push button to the inner hole of the projected portion. When the latch is recessed to the inner hole, the hinge per se is urged in the opening direction by the spring and therefore, the strap coupled by the hinge is brought into the opened state relative to the cabinet of the main body of the wrist mounting type electronic apparatus. The push button may be provided with a flange to prevent from disengaging and dropping from the side face of the recessed portion or the shaft may be locked by the latch receive by a ring lock.

Next, according to the invention, there is provided the wrist mounting type electronic apparatus wherein the latch is provided with a two face width portion at one end portion of a cylindrical shaft thereof and inscribed with a straight line groove at an end portion thereof on an opposed side and the latch receive is provided with a two face width portion fitted to the straight line groove, integrated with a key and engaged with an inner face of the inner hole of the recessed portion.

When the two face width portion is provided at the one end portion of the cylindrical shaft and the inner hole is provided with the shape capable of fitting the two face width portion, the latch is pivoted along with the projected portion of the hinge. The strap of the wrist mounting type electronic apparatus can serve by pivotal movement equal to or smaller than 120 degrees. Therefore, in the pivotal movement range of the strap or the hinge, the straight line groove inscribed at the end portion of the latch is provided with the shape constituting the same direction only by the single angle with the recessed side of the hinge as the reference. (The same direction is constituted only after rotating by 180 degrees.)

The latch receive is provided with the two face width portion fitted to the straight line groove. By the fitting, the latch jumps out from the inner hole. The latch receive is integrated with the key and engaged with the inner face of the inner hole of the recessed portion and therefore, the fitted latch is also bound in the pivotal movement and is fixed. When the latch is fixed, the hinge brought into the fitted state by the two face width portion is also fixed.

Next, according to the invention, there is provided a wrist mounting type electronic apparatus comprising a motor attached to an inner portion of a cabinet of a main body of the wrist mounting type electronic apparatus and having a shaft connected to a piece of a hinge coupled with the main body of the wrist mounting type electronic apparatus and a strap, hinge fixing means for fixing the hinge at a desired angle, and a push button for releasing a fixed state by the hinge fixing means and serving also as a switch of the motor.

The push button constitutes the switch of the motor and therefore, the motor is rotated by pressing the push button. The hinge fixing means is realized by recess and projection engagement for making a groove catch a biting piece, latch engagement for fixing a pivotal movement portion by a latch, or engagement for locking teeth of a gear attached to the shaft of the motor. The push button disengages the engagement and rotates the motor. When the motor is rotated, the rotation is transmitted to the hinge via the shaft to thereby rotate the strap. Thereby, the wrist mounting type electronic apparatus is attached and detached to and from the wrist.

BRIEF DESCRIPTION OF THE DRAWINGS

A preferred form of the present invention is illustrated in the accompanying drawings in which:

FIG. 3 illustrate side sectional views showing an inserted portion.

FIG. 4 illustrate a front view and a side sectional view showing a state in which the inserting portion and the inserted portion are engaged with each other;

FIG. 5 illustrate outlook views showing a back side of a hinge coupled to a strap and the wrist mounting type electronic apparatus main body.

FIG. 6 illustrate side sectional views showing a wrist mounting type electronic apparatus and a hinge according to Embodiment 2 of the invention.

FIG. 7 illustrate enlarged views showing a hole perforated in a main body side hinge piece.

FIG. 11 illustrate a top plane view, a bottom plane view and so on showing a case back of a wrist mounting type electronic apparatus main body;

FIG. 13 illustrate a plane view and a sectional view showing a lower portion of a strap divided upwardly and downwardly;

DETAILED DESCRIPTION OF THE PREFERRED EMBODIMENTS

A detailed explanation will be given of the invention in reference to the drawings as follows. Further, the invention is not limited by the embodiments.

(Embodiment 1)

Figure 1:
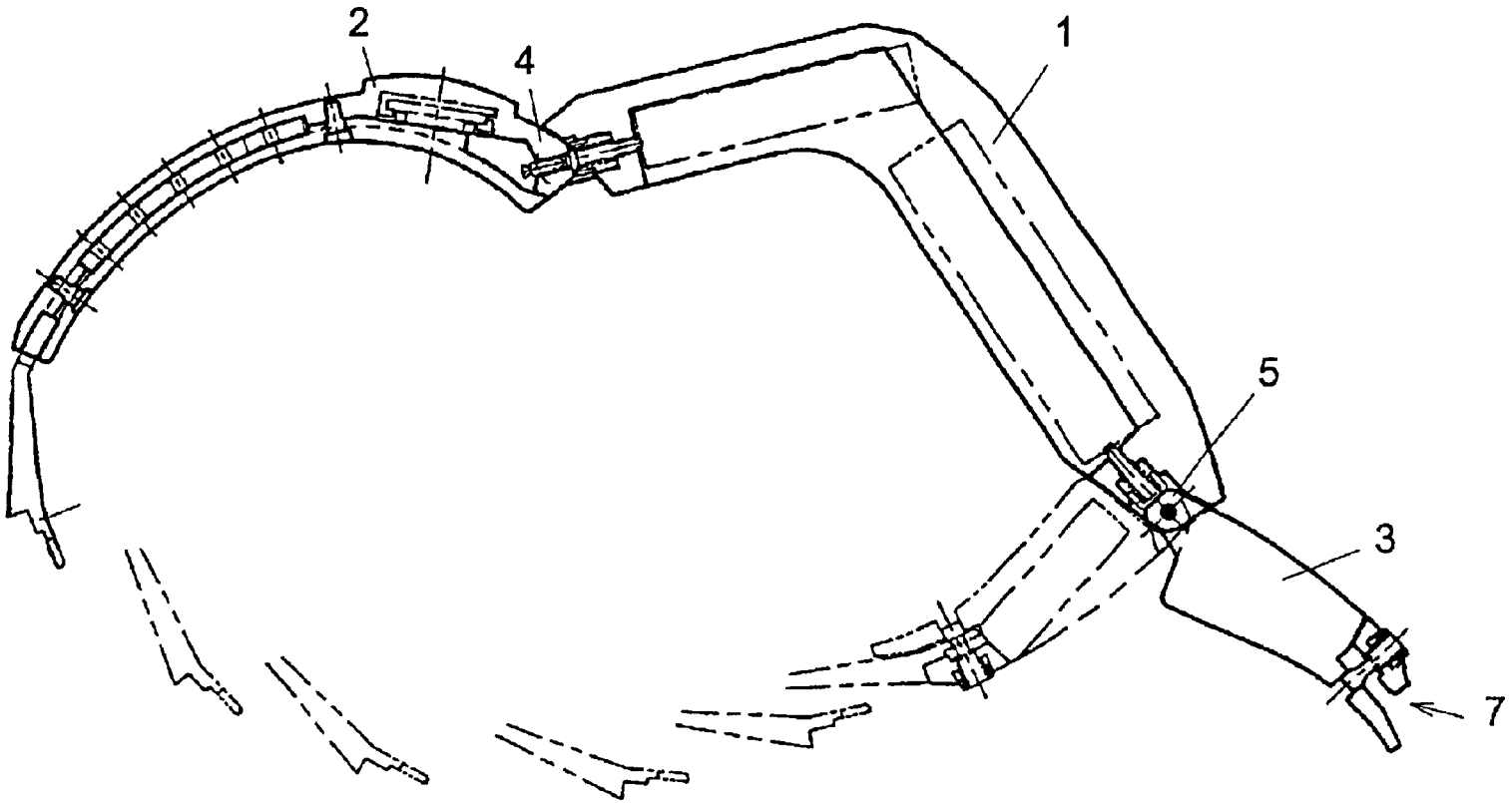
FIG. 1 is a cross-sectional view showing a wrist mounting type electronic apparatus according to Embodiment 1 of the invention.

FIG. 1 is a cross-sectional view showing a wrist mounting type electronic apparatus according to Embodiment 1 of the invention. As shown by the drawing, the wrist mounting type electronic apparatus is constituted by a main body 1 bent substantially in an L-like shape and straps 2 and 3 comprising a hard material. Although in the drawing, two pieces of the straps 2 and 3 are coupled to both sides of the main body 1 by hinges 4 and 5, the constitution may of a type of a single piece or a type constituted by coupling a number of pieces. An inserting portion 6 is provided at a front end of the strap 2 on one side and is engaged with an inserted portion 7 of the pivotable strap 3 on other side by inserting the inserting portion 6 thereinto. Thereby, the wrist mounting type electronic apparatus can be mounted onto the wrist.

Figure 2A:
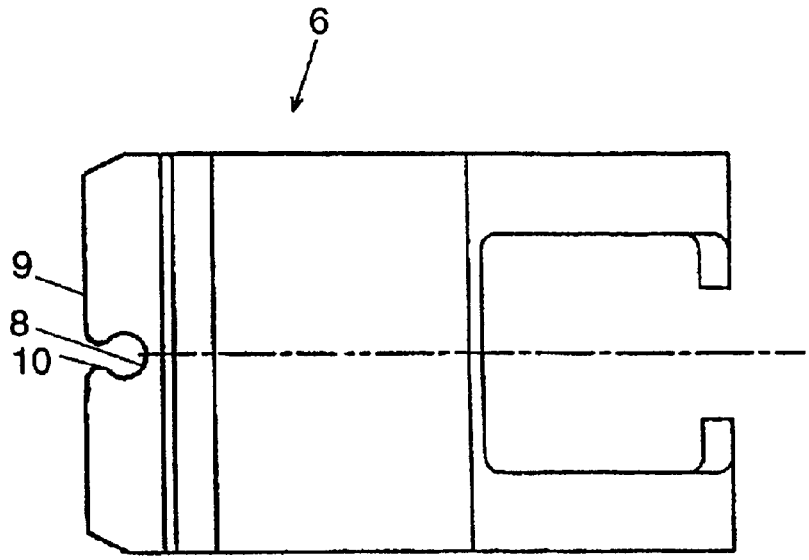
FIG. 2 illustrate a front view and a side sectional view showing an inserting portion.
Figure 2B:
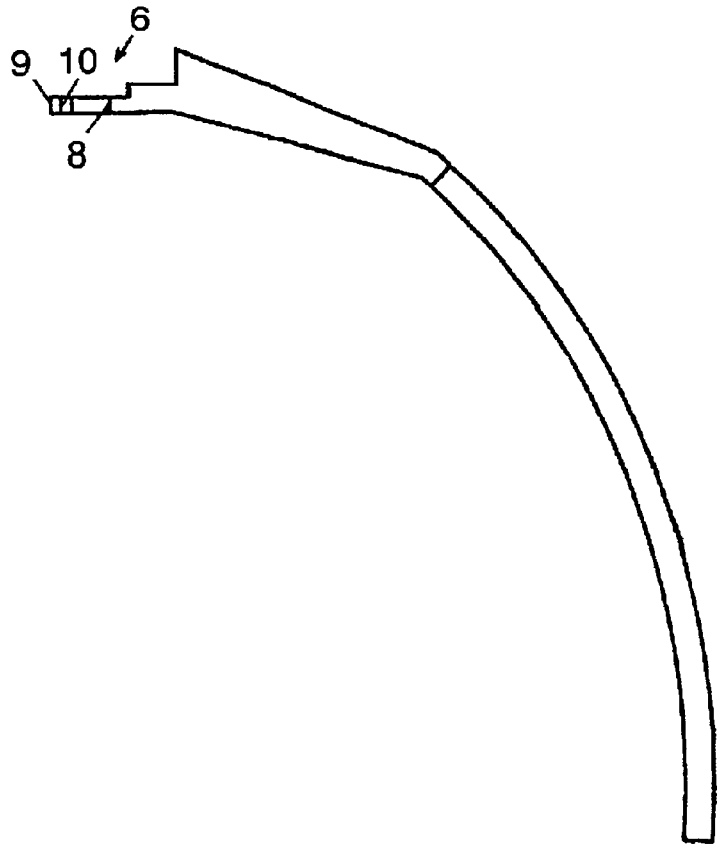

FIGS. 2A and 2B are a front view and a side sectional view showing the inserting portion. The inserting portion 6 is formed in a flat shape and is perforated with a small diameter hole 8 at a vicinity of a central portion thereof. There is provided a groove 10 communicating from an edge portion 9 at a front end to the small diameter hole 8 by a width smaller than that of the small diameter hole 8. Further, a position of perforating the small diameter hole is not limited to the vicinity of the central portion as shown by the drawing. Further, a number of perforating the small diameter hole is not limited to one. Although here, there is shown a case in which a part forming the inserting portion 6 is extended to inside of the strap, the part is not necessarily extended but the inserting portion 6 may be formed at the front end of the strap.

Figure 3A:
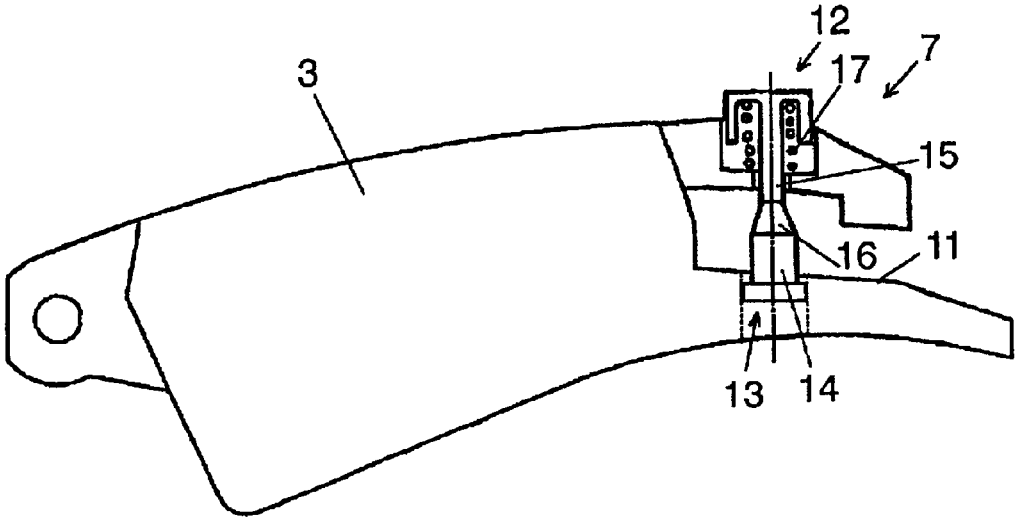
FIG. 3A is a side sectional view showing a state in which a push button is not pressed and FIG. 3B is a side sectional view showing a state in which the push button is pressed.
Figure 3B:
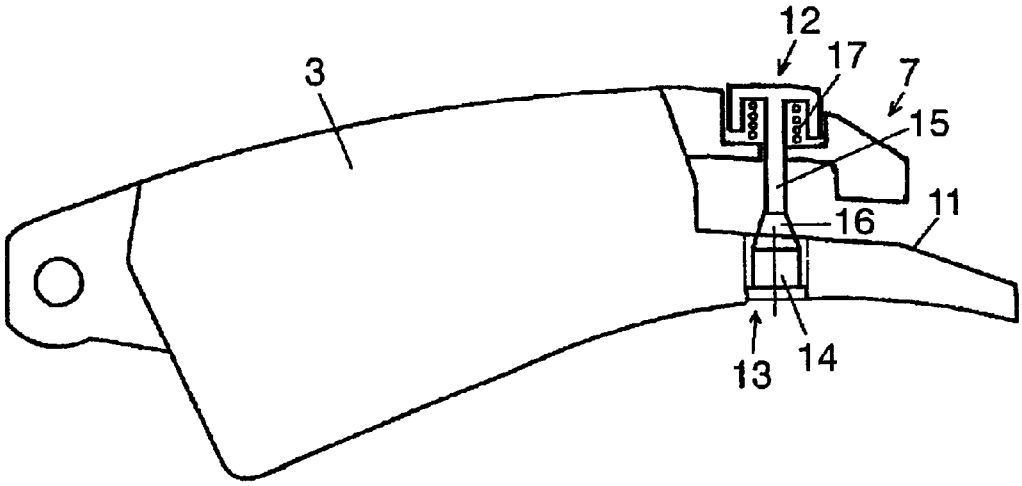

FIG. 3 illustrate side sectional views showing the inserted portion. FIG. 3A is a side sectional view showing a state in which a push button is not pressed and FIG. 3B is a side sectional view showing a state in which the push button is pressed. The inserted portion 7 is provided with a slot portion 11 slightly higher than the inserting portion. Inside of the slot portion 11 is penetrated by a rod member 13 extended to a push button 12. Further, although here, the inserted portion 7 is provided at a cabinet of the strap 3, the inserted portion 7 may be provided at a cabinet of a main body of the wrist mounting type electronic apparatus.

The rod member 13 is constituted by a shape connecting a shaft portion 14 having a diameter substantially the same as that of the small diameter hole of the inserting portion and a shaft portion 15 having a diameter by a width smaller than that of the groove communicating with the small diameter hole by a taper 16 the diameter of which is reduced toward a side of the push button 12. Further, when the push button 12 is not pressed, the shaft portion 14 and the taper 16 are held by a spring 17 to expose to the slot portion 11 and when the push button 12 is pressed, the shaft portion 15 is exposed to the slot portion 11. Further, the rod member 13 is attached with a lock ring at the shaft portion 15 at inside of the slot portion 11 to prevent from drawing from the side of the push button 12.

FIGS. 4A and 4B are a front view and a side sectional view showing a state of engaging the inserting portion with the inserted portion. When the inserting portion 6 is inserted into the slot portion of the inserted portion 7, an edge portion of the inserting portion 6 is brought into contact with the taper of the rod member 13 and the rod member 13 per se is pushed down. Further, the groove provided at the flat portion of the inserting portion 6 passes the rod member having the diameter smaller than the width of the groove. After passing therethrough, the rod member returns to an original position by being urged by the spring and the diameter of the rod member penetrating the small diameter hole of the inserting portion 6 is increased to thereby prevent the rod member from reversely returning from the groove. At this occasion, the rod member stays at the small diameter hole.

Figure 5A:
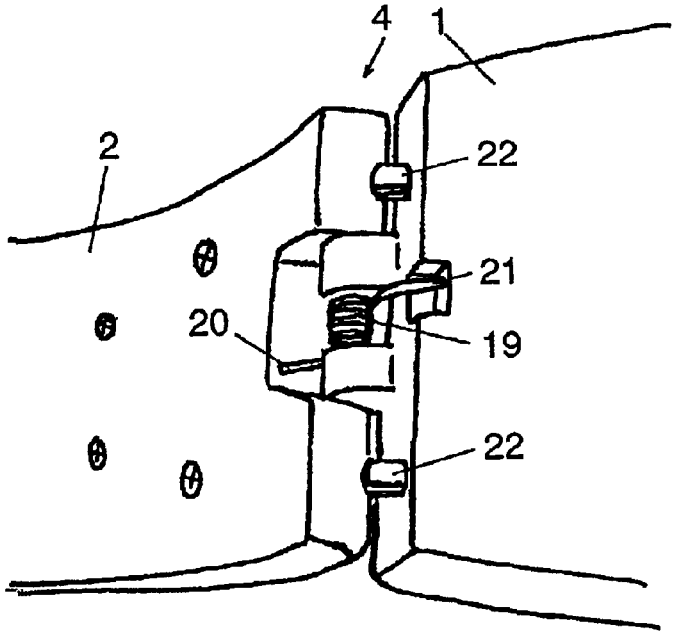
FIG. 5A is a outlook view showing a back side of one hinge and FIG. 5B is an outlook view showing a back side of other hinge.
Figure 5B:
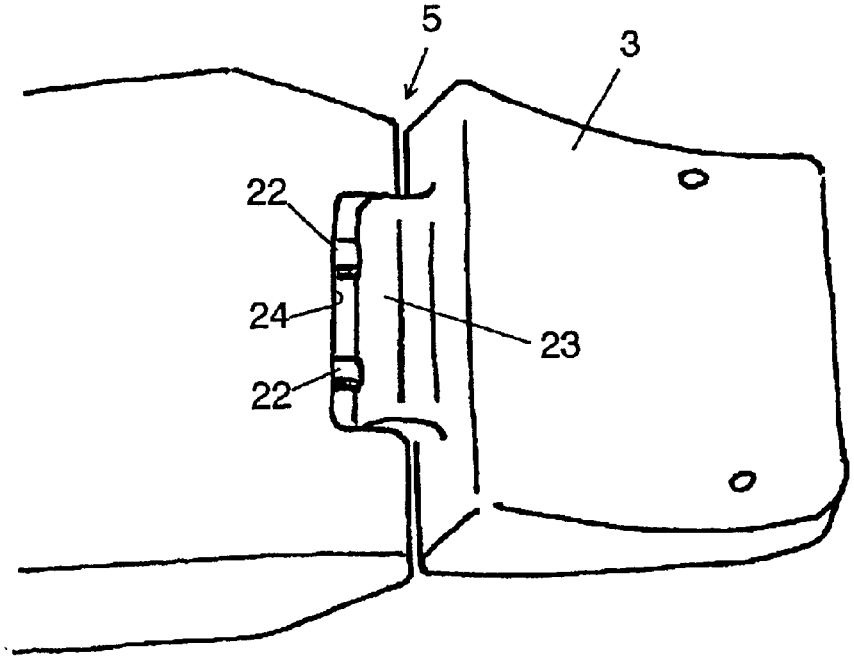

FIG. 5 illustrate outlook views showing a backside of the hinge for coupling the main body of the wrist mounting type electronic apparatus and the strap. FIG. 5A is an outlook view showing the hinge constituting a coupling portion of the main body of the wrist mounting type electronic apparatus and the strap having the inserting portion and FIG. 5B is an outlook view showing the hinge constituting a coupling portion of the main body of the wrist mounting type electronic apparatus and the strap having the inserted portion.

As shown by FIG. 5A, the hinge 4 of the strap 2 having the inserting portion is provided with a coil spring 19. Further, projected portions 20 and 21 provided at both ends of the coil spring 19 are respectively brought into contact with the strap 2 and the wrist mounting type electronic apparatus main body 1. Thereby, so far as the strap 2 is not engaged, the strap 2 maintains an opened state relative to the cabinet of the main body 1. Further, in order to urge the strap in an opening direction, end portions of a leaf spring may similarly be constituted.

As shown by FIG. 5B, the hinge 5 for coupling the wrist mounting type electronic apparatus main body 1 and the strap 3, may be or may not be attached with a coil spring. One face 23 forming the hinge 5 is combined with a flat face and a curved face and other face 24 is provided with press pins 22 moved straightly by springs for pressing the face 23. When the face 23 is the curved face, the press pins 22 make pivotal movement smooth without being caught thereby and prevent play therebetween.

Further, when the face 23 is the flat face, the strap 3 coupled to the hinge 5 by the angle is difficult to rotate. Thereby, the strap settles excellently at a convenient position. Further, in view of preventing play and making pivotal movement smooth, it is preferable to provide the press pins 22 also at the hinge 4 shown in FIG. 5A. Thereby, attachment and detachment of the wrist mounting type electronic apparatus by the single hand is facilitated.

In this way, according to the wrist mounting-type electronic apparatus of Embodiment 1, engagement of the inserting portion and the inserted portion is disengaged by the push button and the strap is brought into the opened state and therefore, the wrist mounting-type electronic apparatus can promptly be dismounted from the wrist. There also is the case in which the wrist mounting-type electronic apparatus is intended to attach and detach promptly from and to the wrist depending on its function such as a communication function and accordingly, in that case, the invention is significantly convenient. Further, according to the invention, the straps are formed of a hard material and therefore, the wrist mounting-type electronic apparatus is mounted onto the wrist extremely easily. Further, according to the invention, the straps are engaged by combining the inserting portion and the inserted portion and accordingly, the engagement can optically be recognized easily and handling there of is also facilitated.

Further, according to the invention, in the case in which the straps comprise two pieces, when the engagement is disengaged, the straps can be brought into an opened state on both sides of the main body and therefore, the straps can be built with a microphone and a speaker. Thereby, from a similarity between a length around the wrist and a length between the ear and the mouth, the wrist mounting-type electronic apparatus is easy to use in both modes of mounting the wrist mounting-type electronic apparatus on the wrist and inputting the wrist mounting type electronic apparatus to the ear and the mouth.

(Embodiment 2)

Figure 6A:
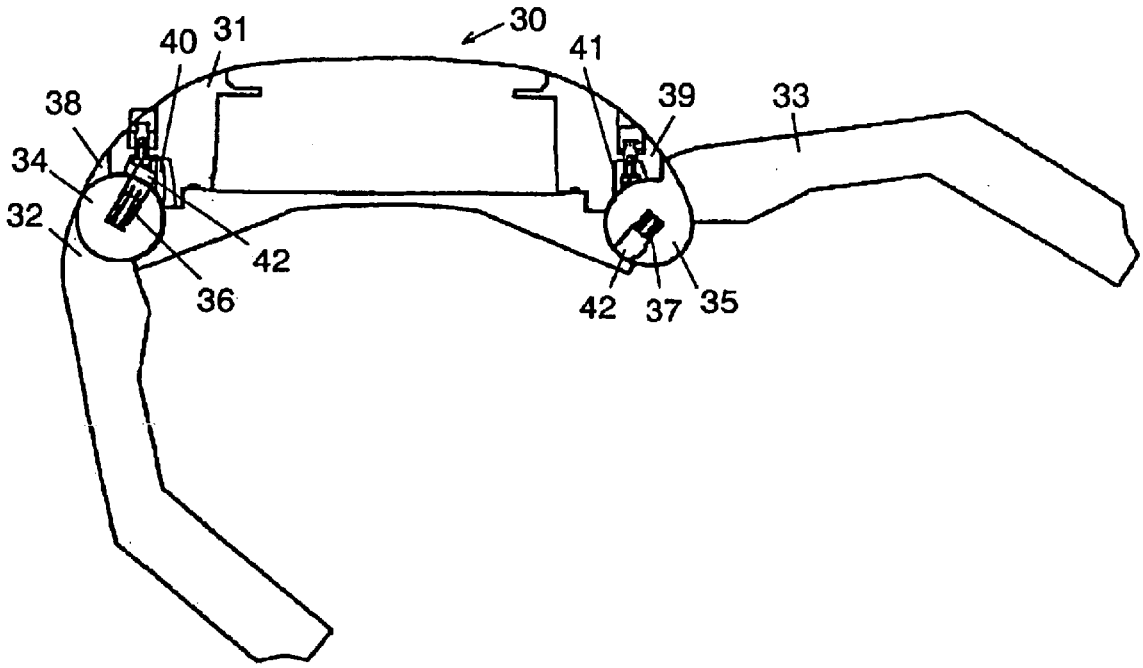
FIG. 6A is a side sectional view showing a total of the electronic apparatus and FIG. 6B is a front view showing a hinge portion.
Figure 6B:
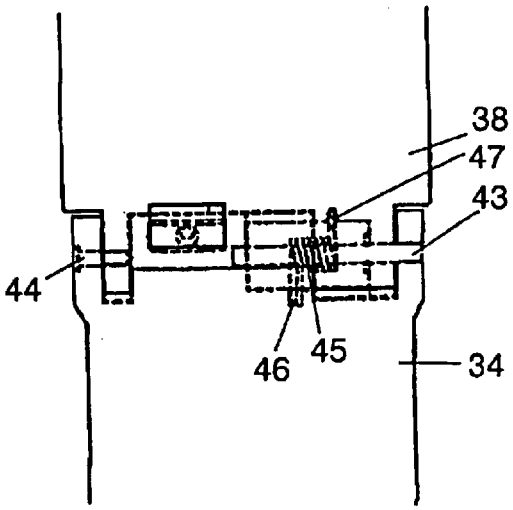

FIGS. 6A–6B illustrate side sectional views showing a wrist mounting type electronic apparatus and hinges according to Embodiment 2 of the invention. FIG. 6A is a side sectional view showing a total of the electronic apparatus and FIG. 6B is a front view showing a hinge portion. A wrist mounting type electronic apparatus 30 shown in FIG. 6A is constituted by a main body 31 and two pieces of straps 32 and 33. In the drawing, the strap 32 on the left side of the paper face shows a closed state and the strap 33 on the right side shows an opened stated. The main body 31 and the strap 32 and 33 are coupled by two hinge units, each having hinge members 34, 38 and 35, 39, respectively (hereinafter referred to as "hinge pieces"). Bores 36 and 37 (hereinafter referred to as "holes") are perforated in diameter directions at surfaces of hinge pieces 34 and 35 on sides of the straps 32 and 33.

Hinge pieces 38 and 39 opposed to the holes 36 and 37 are also provided with cavities 40 and 41 (hereinafter referred to as "holes"). Mechanisms of the left and the right hinges are the same and therefore, here, for convenience, an explanation will be given of the hinge on the left side. A latch pin 42 urged to an opening side by a spring is contained in the hole 36 of the hinge piece 34 on one side. By pivotal movement of the strap 32 and accordingly, by pivotal movement of the hinge piece 34, the hole 36 is also pivoted. Further, when the hole 36 is opposed to the hole 40 of the hinge piece 38 opposed thereto, the latch pin 42 is fitted to the opposed hole 40. Thereby, the hinge piece 34 and the strap 32 integral therewith are fixed.

As shown by FIG. 6B, the hinge pieces 34 and 38 are coupled by a pivotal movement pair by a spring bar 43 and a fitting screw 44. A coil spring 45 is penetrated by the spring bar 43 and projected portions 46 and 47 at both ends thereof are brought into contact with the respective hinge pieces 34 and 38. Thereby, the hinge pieces 34 and 38 are always urged in the direction of opening the strap. Further, the spring for urging the strap in the opening direction may be constituted by a leaf spring.

Figure 7A:
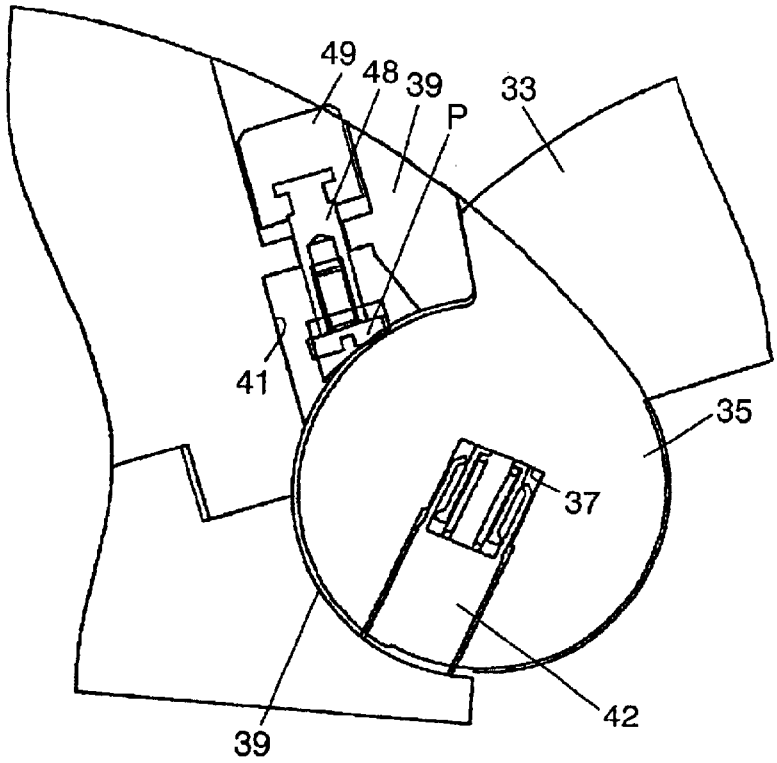
FIG. 7A is a cross-sectional view showing a state in which a hinge is not fixed and FIG. 7B is a cross-sectional view showing a state in which the hinge is fixed.
Figure 7B:
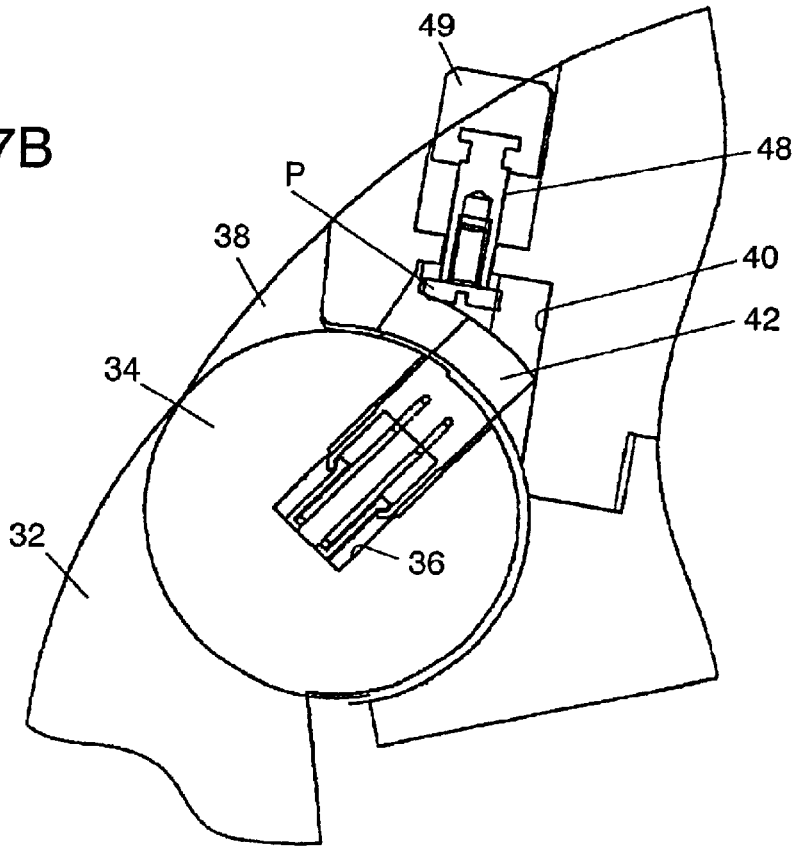

FIG. 7 illustrate enlarged views showing the hole perforated at the hinge piece on the main body side. FIG. 7A is a cross-sectional view showing a state in which the hinge is not fixed and FIG. 7B is a cross-sectional view showing a state in which the hinge is fixed. As shown by FIG. 7A, in the state of opening the strap 33, the latch pin 42 is contained at inside of the hole 37 by constituting a barrier by the opposed hinge piece 39. In FIG. 7B, the latch pin 42 is fitted to the hole 40 and by force of the strap 32 which is going to be opened, the latch pin 42 is brought into press contact with one side wall of the hole 40. Thereby, the strap 32 is fixed in the closed state.

Further, a push mechanism comprises a pin member or push-out bar 48 integrated with a button member or push button 49 to serve to push out the latch pin 42 fitted to the hole 41 or 41 by moving in an up and down direction. When the latch pin 42 is pushed out from the hole 40 or 422, the strap 32 or 33 is made pivotable and is brought into the opened state relative to the main body of the cabinet by being urged by the spring. Further, a number of the strap coupled by the hinge may be one or may be two. Further, it is preferable to provide a plate P having a large sectional area at the front end of the push-out bar 48. Further, when the push button 49 is urged to return to the original position toward the outer side of the main body by a spring, the push button 49 is easy to push.

In this way, according to the wrist mounting type electronic apparatus of Embodiment 2 of the invention, engagement between the latch and the hole is disengaged by the push button and the strap is brought into the opened state and accordingly, the wrist mounting type electronic apparatus can promptly be disengaged from the wrist. Further, according to the invention, when the wrist mounting type electronic apparatus is mounted onto the wrist, the strap is fixed by the hole and the latch provided at the hinge and therefore, a user may simply push the strap onto the wrist with no concern on position or state of fitting. Further, when two straps are provided, the respective straps can be built with a microphone and speaker. Thereby, from a similarity between a length around the wrist and a distance between the ear and the mouth, there can be constituted the wrist mounting type electronic apparatus capable of being used in both modes of mounting the wrist mounting type electronic apparatus on the wrist and putting the wrist mounting type electronic apparatus to the ear and the mouth.

(Embodiment 3)

Figure 8:
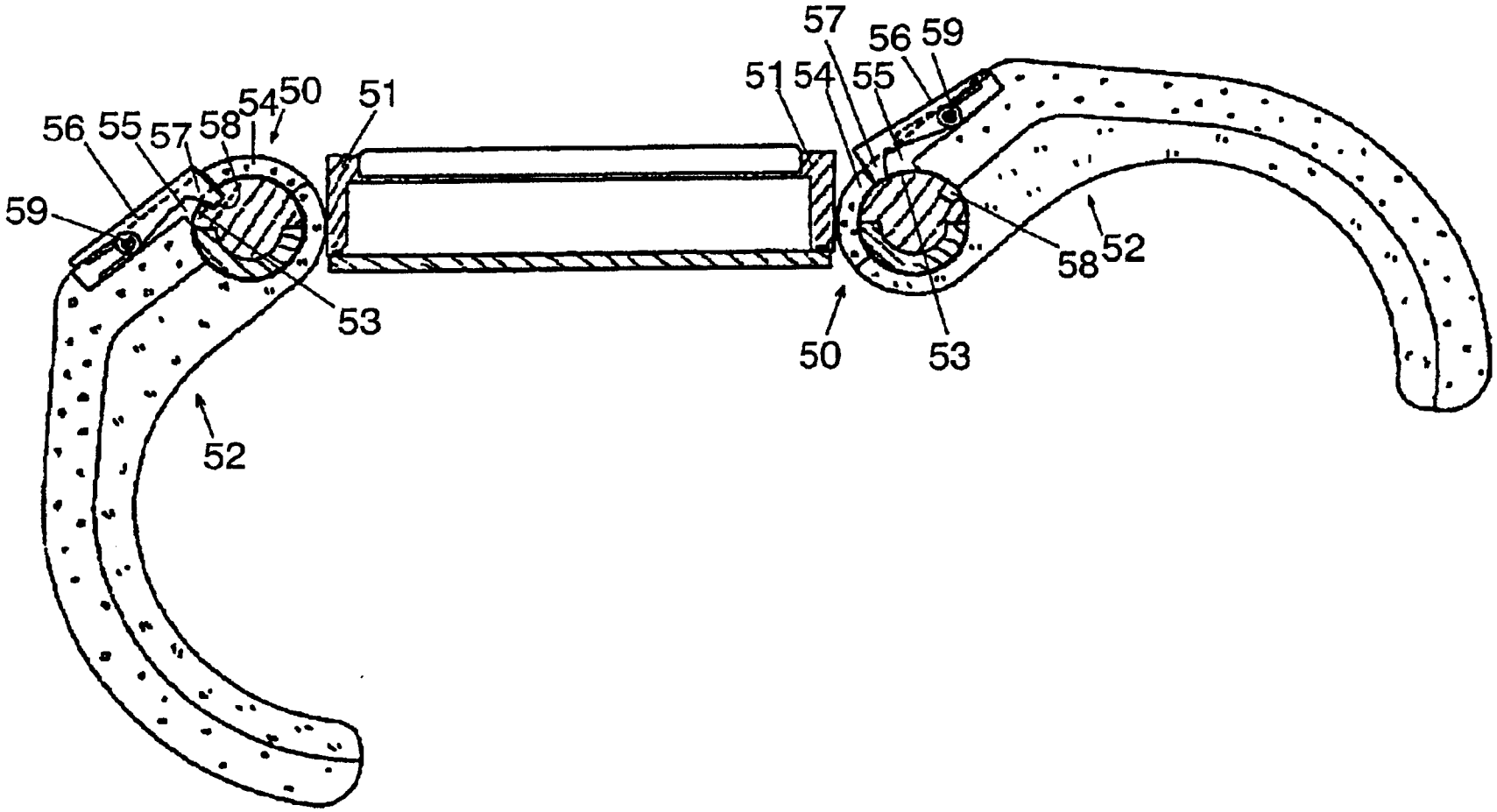
FIG. 8 is a cross-sectional view showing a wrist mounting type electronic apparatus according to Embodiment 3.

FIG. 8 is a cross-sectional view showing a wrist mounting type electronic apparatus according to Embodiment 3.

Generally a hinge is provided with the structure in which two hinge pieces are pivoted relative to each other. As the pivoting structure, there are pointed out recess and projection fitting and a slide structure of a shaft portion constituting its longitudinal direction by a direction of a pivoting shaft and a cover portion covering the shaft portion. According to the invention, there is used a hinge at least having the latter structure. Further, although according to the drawing, a hinge 50 seems to be separated and floated from a wrist mounting type electronic main body 51, this is because a sectional view of a shaft portion is shown and the hinge 50 necessarily couples the main body 51 and a strap.

A strap 52 can be divided upwardly and downwardly and is provided with a cover portion 54 for covering a shaft portion 53 which is long in an axial direction of the hinge. A window portion 55 is provided at a surface of the cover portion 54 and the shaft portion 53 is exposed therefrom. A bite bar 56 is provided at the window portion 55 and is urged by a spring 59 in a direction in which a projection 57 bites a groove 58 of the shaft portion 53. Therefore, when there is not the groove 58 at the shaft portion 53 exposed from the window portion 55, the projection 57 does not bite the groove 58 and pivotal movement of the hinge is freed. When the strap 52 is pivoted and there is constituted an angle at which the groove 58 is exposed to the window portion 55, the projection 57 of the bite bar 56 bites the groove 58 and the pivotal movement of the strap 52 is fixed.

When an end portion of the bite bar 56 on a side opposed to the projection 57 is pushed since the bite bar 56 is provided in a shape of a seesaw with a pin as a fulcrum and therefore, the projection 57 is disengaged from the groove 58 and pivotal movement of the strap 52 is freed. The strap 52 is urged in an opening direction by a spring and therefore, when its pivotal movement is freed, the strap 52 maintains an opened state relative to the main body 51 of the wrist mounting type electronic apparatus. Further, the window portion 55 provided with the bite bar 56 may be disposed at a cabinet of the wrist mounting type electronic apparatus main body 51 or may be disposed at the strap 52. The spring for urging the strap in the opening direction is attached similar to Embodiment 1 or 2.

Figure 9:
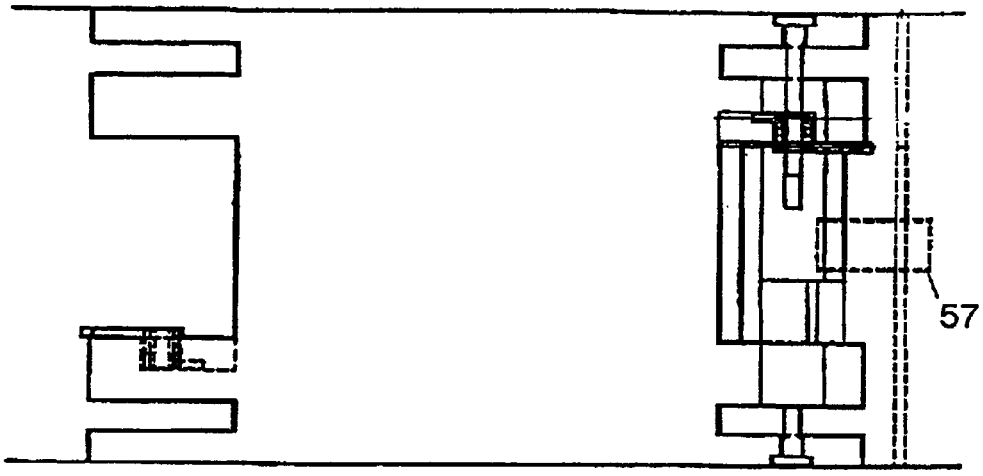
FIG. 9 illustrates a top plane view and a bottom plane view showing a coupled state of a hinge.

Further, according to the invention, the hinge portion is liable to be complicated and accordingly, an outline view showing respective parts as reference in reducing the invention to practice, will be shown here. FIG. 9 illustrates a top plane view and a bottom plane view showing a coupled state of the hinge. Although hinge pieces are fitted by pluralities of recesses and projections, among them, a central fitting portion forms the shaft portion. A counter part side of the shaft portion is formed with the cover portion covering the shaft portion. The bite bar 57 is provided with a penetrating pin penetrating the strap as a fulcrum.

Figure 10:
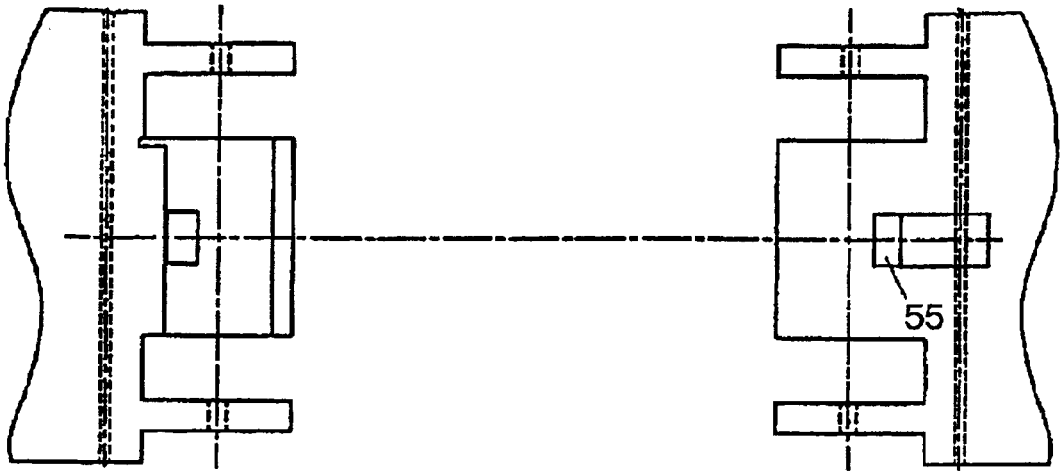
FIG. 10 illustrates a top plane view and a bottom plane view showing a strap side hinge piece.
Figure 12A:
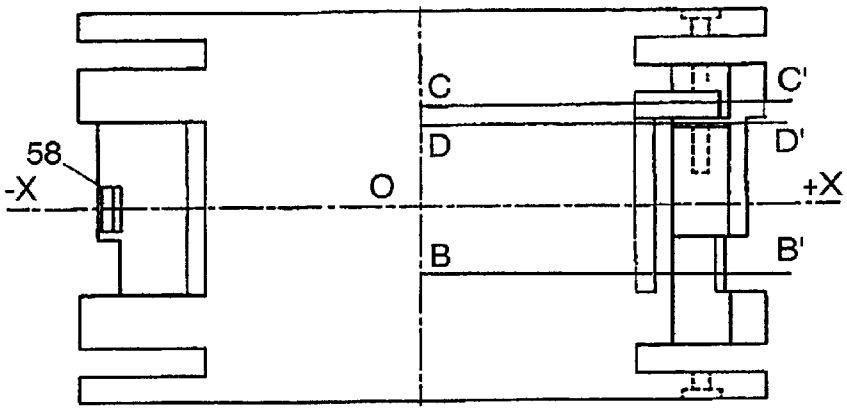
FIG. 12 illustrate a top plane view, a bottom plane view and so on showing a hinge on a side of the wrist mounting type electronic apparatus main body.
Figure 12C:
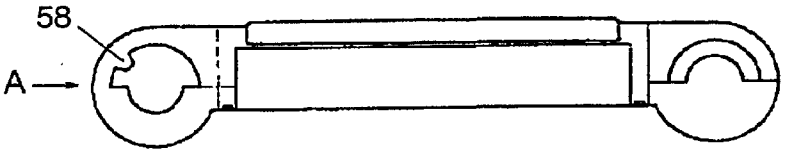
Figure 12B:
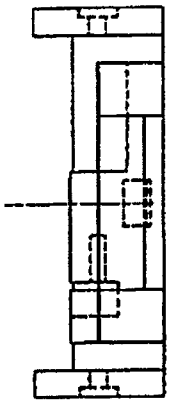
Figure 12D:
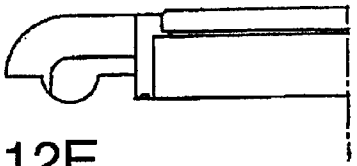
Figure 12E:
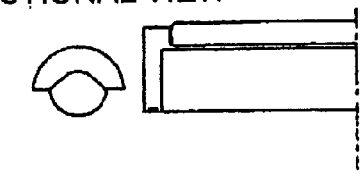

FIG. 10 illustrates a top plane view and a bottom plane view showing strap side hinge pieces. The cover portion is provided to cover an upper half of the shaft portion. The cover portion is attached with the window portion 55. FIGS. 11A through 11D illustrate a top plane view, a bottom plane view, a side view, a sectional view taken along a line B—B and a sectional view taken along a line C—C showing a case back of the wrist mounting type electronic apparatus main body. A shaft portion sandwiched by projected portions having a section in a semicircular shape and similarly having a section in a semicircular shape, is combined with a shaft portion on the main body side to thereby constitute the shaft portion in a cylindrical shape.

FIGS. 12A through 12E illustrate a top plane view, a bottom plane view and sectional views between respective references showing a hinge piece on the wrist mounting type electronic apparatus main body side. The main body side hinge piece is provided on an upper side of FIG. 11. The shaft portion is provided with the bite groove 58 which the bite bar bites. FIGS. 13A and 13B illustrate a plane view and a sectional view showing a lower portion of the strap divided upwardly and downwardly. The lower portion covers the shaft portion and looks like a smooth curved face in its appearance.

As described above, according to the wrist mounting type electronic apparatus of Embodiment 3 of the invention, when the end portion of the bite bar opposed to the projection is pushed, pivotal movement of the strap is freed simply. The strap is urged by the spring and therefore, when the pivotal movement is freed, the strap maintains the opened state relative to the main body of the wrist mounting type electronic apparatus. Therefore, the invention achieves an effect of capable of promptly dismounting the wrist mounting type electronic apparatus from the wrist.

Further, according to the invention, when the wrist mounting type electronic apparatus is mounted onto the wrist, the mounting member is fixed by the groove and the bite bar provided at the hinge and therefore, the user may simply push the strap to the wrist with no regard of position or state of biting. Further, when two of the straps are provided, the respective straps can be built with a microphone and a speaker. Thereby, from a similarity between a length around the wrist and the distance between the ear and the mouth, there can be constituted the wrist mounting type electronic apparatus capable of being used in both modes for mounting the wrist mounting type electronic apparatus onto the wrist and putting the wrist mounting type electronic apparatus to the ear and the mouth.

(Embodiment 4)

Figure 14:
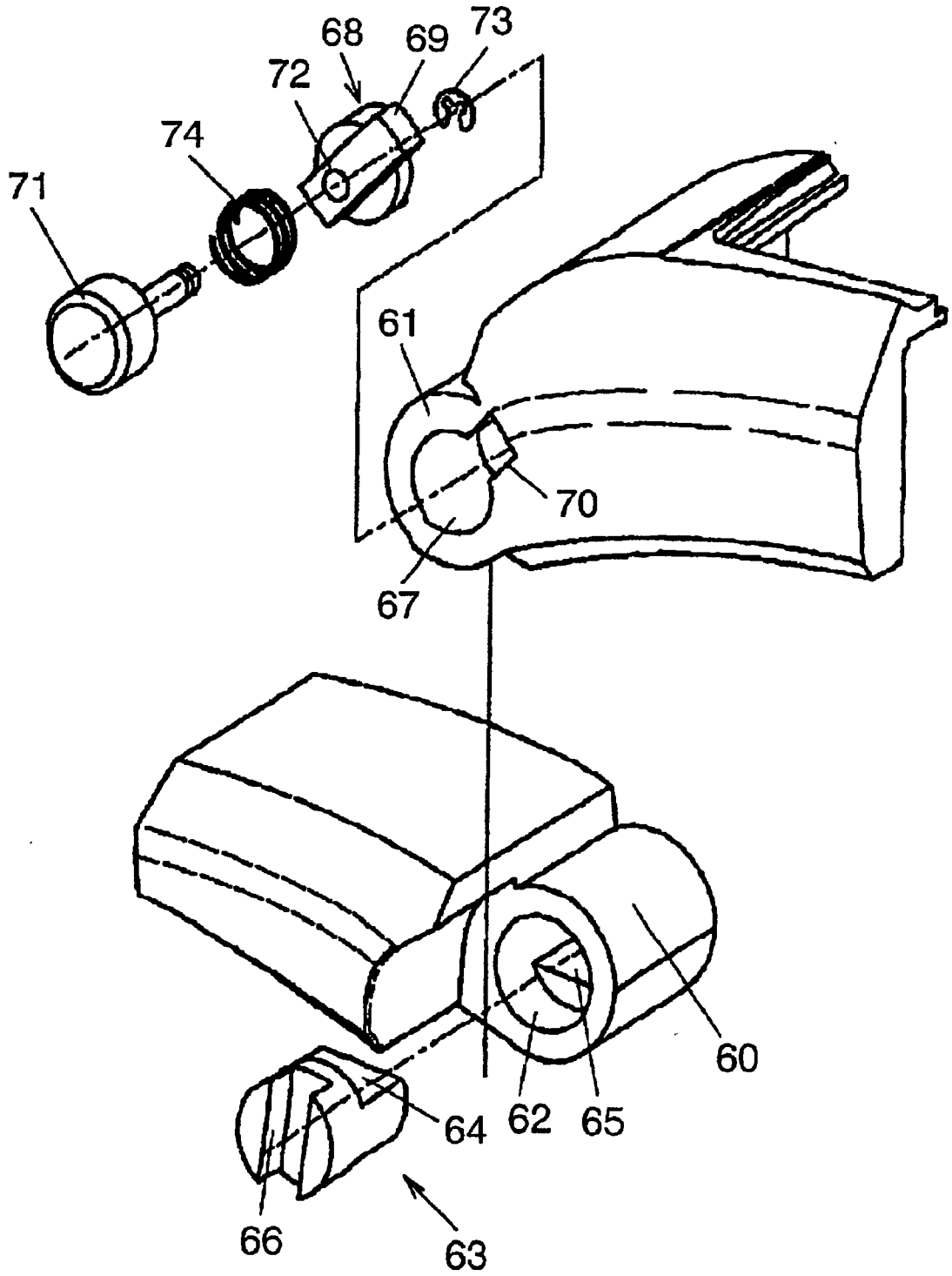
FIG. 14 is a disassembled view showing a hinge portion in a wrist mounting type electronic apparatus according to Embodiment 4.

FIG. 14 is a disassembled view showing a hinge portion in a wrist mounting type electronic apparatus according to Embodiment 4. A hinge is constituted by two pieces of hinge pieces 60 and 61 having recessed and projected portions. A latch 63 is provided at an inner hole 62 of the hinge piece 60 on the projected portion side. At an end portion of the latch 63 constituting a cylindrical shaft, a two face width portion 64 is provided and fitted to a straight line groove 65 at inside of the inner hole 62. Thereby, the latch 63 is bound in pivoting at inside of the inner hole 62 and is pivoted along with the hinge piece 60 on the projected portion side. Further, the latch 63 is urged by a spring from an inner side of the hole 62 in a direction of jumping out to an opening side and an end portion thereof in the direction of projecting the latch 63 is inscribed with a straight line groove 66.

A latch receive 68 is inserted into an inner hole 67 perforated in a direction of a pivoting shaft at the hinge piece 61 on the recessed side. The latch receive 68 is integrated with a key 69 which is engaged with a key groove 70 of an inner hole 67. Thereby, the latch receive 68 is bound in pivoting in the inner hole 67 and integrated with the hinge piece 61 on the recessed side. Further, the latch receive 68 is provided with a two face width portion (not illustrated) fitted to the straight line groove 66. Further, when the straight line groove 66 of the latch 63 pivoting along with the hinge piece 60 on the projected side and the two face width portion of the latch receive, coincide with each other, the latch 63 jumps out in the axial direction from a vicinity of a side face of the inner hole and is fitted to the latch receive 68. By the fitting operation, the hinge is fixed.

A push button 71 inserted into the hinge piece 61 on the recessed side, penetrates a hole 72 perforated at the latch receive 68 and is engaged by a lock ring 73 on the opposed side. The push button 71 serves to push back the fitted latch 63 in a direction of the inner hole 52 on the projected side. Further, when a coil spring 74 is interposed between the push button 71 and the latch receive 68, the push button 71 is always urged to facilitate to push.

Meanwhile, when a consideration is given to one side strap of the wrist mounting type electronic apparatus, the strap can serve by pivotal movement equal to or smaller than at least 120 degrees. In the pivotal movement range of the strap or the hinge, the straight line groove 66 inscribed at the end portion of the latch 63 is formed by a shape constituting the same direction only by a single angle with the recess side of the hinge as a reference. (The same direction is constituted only after rotating by 180 degrees.) Thereby, the strap is fixed only at a certain angle. When the fixed angle adapts to a wrist size of the user, the strap is fixed at two locations of the state and a state in which the strap is maximally opened by the spring.

Further, here, the hinge piece 61 on the side of the wrist mounting type electronic apparatus main body is provided on the recessed side and the hinge piece 60 on the side of the strap is provided on the projected side. Even when the arrangement is reversed, only the position of the push button is disposed on the side of the strap and there is no difference therebetween in principle. Further, the push button 71 may be provided to either of left and right side faces of the main body or the strap.

Figure 15:
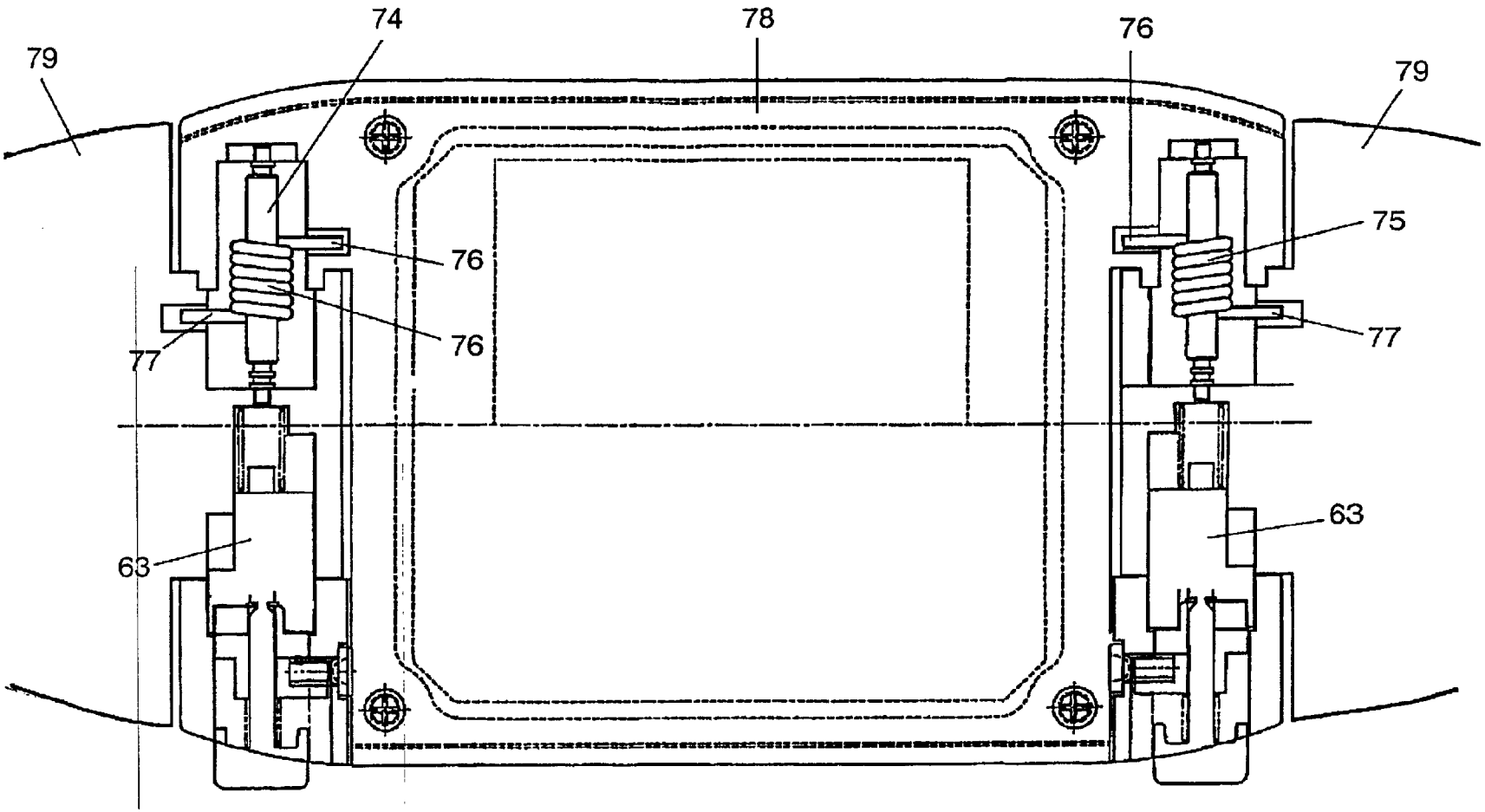
FIG. 15 is a plane sectional view showing an inner portion of a hinge.

FIG. 15 is a plane sectional view showing an inner portion of the hinge. As shown by the drawing, the projected side and the recessed side of the hinge are made pivotable by a pivoting shaft pin 74 and the latch 63 slightly jumping out from the projected side. The pivoting shaft pin 74 penetrates a coil spring 75 and projected portions 76 and 77 provided at both ends of the coil spring 75 are respectively brought into contact with a main body 78 and a strap 79. Thereby, the main body 78 and the strap 79 are urged to always open.

In this way, according to the wrist mounting type electronic apparatus of Embodiment 4, by pressing the push button, latch engagement of the projected portion and the recessed portion of the hinge can easily be disengaged. When the engagement is disengaged, since the hinge per se is urged in the opening direction by the spring, the strap coupled by the hinge is brought into an opened state relative to a cabinet of the wrist mounting type electronic apparatus main body. Therefore, the invention achieves an effect of capable of promptly disengaging the wrist mounting type electronic apparatus from the wrist. Further, according to the invention, when the wrist mounting type electronic apparatus is mounted onto the wrist, the mounting member is fixed by the latch and the latch receive provided at the inner hole of the hinge and accordingly, the user may simply press the strap to the wrist with no regard of a state of fitting by the latch which occurs at inside thereof.

Further, when two of the straps are provided, the respective straps can be built with a microphone and a speaker. Thereby, when the wrist mounting type electronic apparatus is provided with a communication function, from a similarity between a length around the wrist and a distance between the ear and the mouth, the wrist mounting type electronic apparatus can be used by both modes of mounting the wrist mounting type electronic apparatus onto the wrist and putting the wrist mounting type electronic apparatus to the ear and the mouth.

(Embodiment 5)

Figure 16:
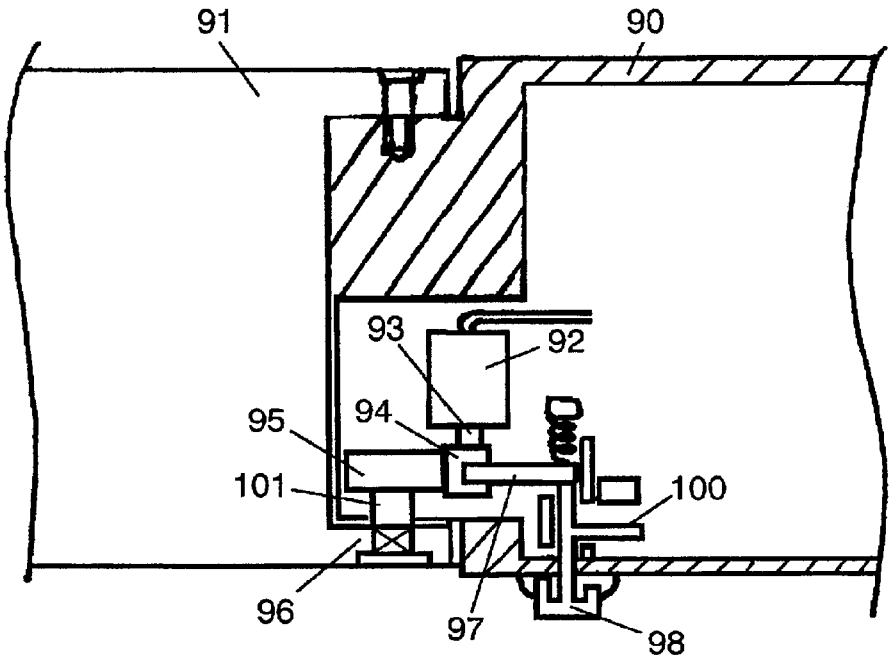
FIG. 16 is a front sectional view showing a wrist mounting type electronic apparatus according to Embodiment 5.

FIG. 16 is a front sectional view showing a wrist mounting type electronic apparatus according to Embodiment 5. In the drawing, there is shown a hinge for coupling a wrist mounting type electronic apparatus main body 90 and a strap 91 at its center. A motor 92 is attached to inside of a cabinet of the main body 90. A pinion 94 is provided at a shaft 93 of the motor 92 and rotation of the motor 92 is transmitted to a strap side hinge piece 96 via a speed reducer 95. The pinion 94 is engaged with a teeth lock claw 97. The teeth lock claw 97 is movable and can be escaped in the axial direction of the shaft 93 of the motor 92 by pressing a push button 98. When pressing by the push button 98 is removed, the teeth lock claw 97 returns to an original position by a spring 99.

Further, the push button 98 is provided with an electric contact 100 and serves also as a switch of the motor 92. Therefore, by pressing the push button 98, locking of teeth of the pinion is disengaged and the motor can be rotated. Further, the speed reducer 95 is provided for adjusting a rotational number and torque of the motor and needs not to be provided necessarily. It is preferable that a shaft 101 fitted to the strap side hinge piece 96 is provided with the section in a polygonal shape or provided with a key such that rotational slip is not caused.

Further, there are various methods of locking rotation of the motor 92 and there are a type of locking in two directions and a type of preventing from rotating reversely only in one side rotation. For example, there also is the case in which the hinge is urged in one direction by a spring and locking is carried out in a direction of hampering the urge. According thereto, it is preferable to select a suitable type in correspondence with use of the wrist mounting type electronic apparatus.

Figure 17:
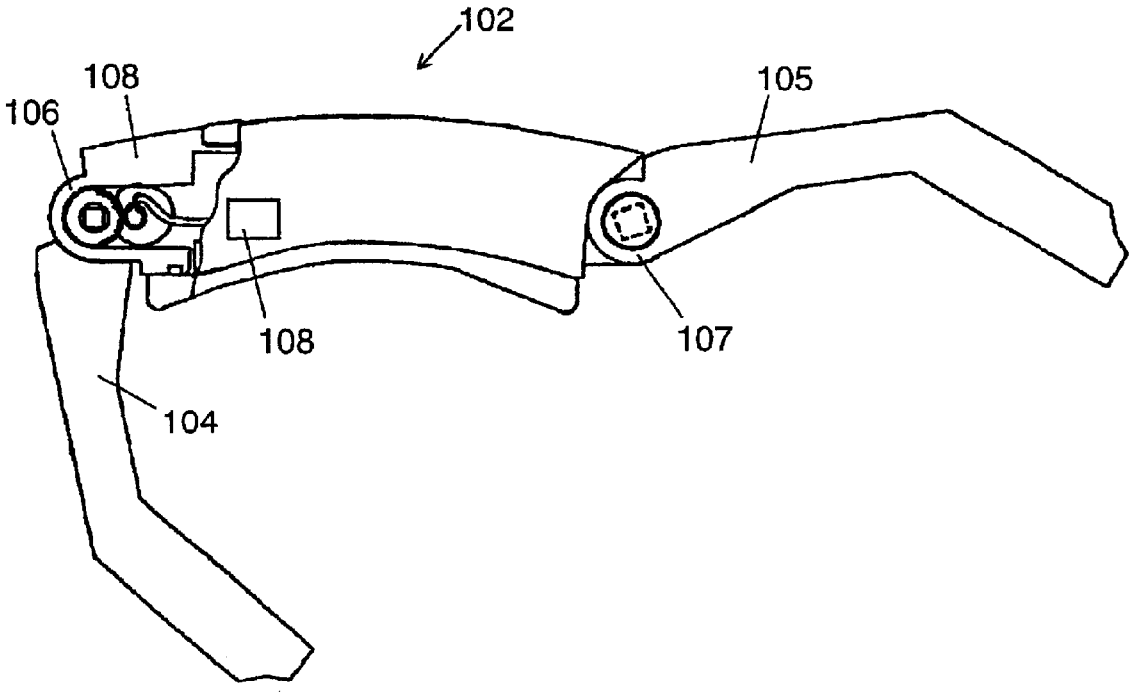
FIG. 17 is a side view showing a wrist mounting type electronic apparatus of a motor drive system.
Figure 18:
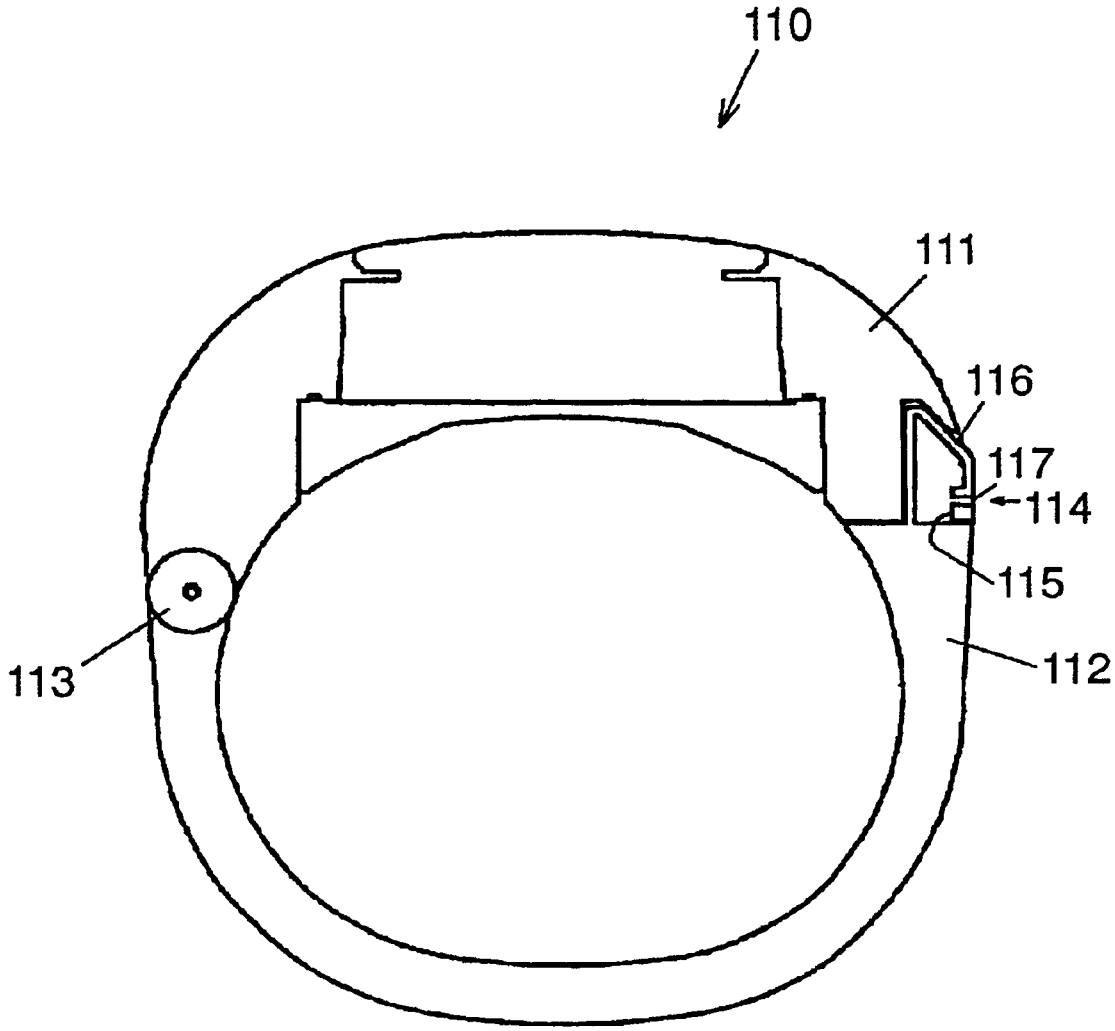
FIG. 18 PRIOR ART
FIG. 18 is a constitution view showing a conventional wrist mounting type electronic apparatus.

FIG. 17 is a side view showing a wrist mounting type electronic apparatus built with the above-described mechanism. The wrist mounting type electronic apparatus 102 is of a type in which a main body 103 and two pieces of straps 104 and 105 are coupled via hinges 106 and 107. In the drawing, a single one of a push button 108 is provided at its side face. The single one of the push button 108 may govern pivotal movement of the left and right straps 104 and 105 in this way or two of the push buttons 108 may be provided at the respective straps 104 and 105.

In this way, according to the wrist mounting type electronic apparatus of Embodiment 5, by the push button, the hinge piece is pivoted, the strap is opened and closed and therefore, attachment and detachment of the wrist mounting type electronic apparatus to and from the wrist is facilitated. When the wrist mounting type electronic apparatus is provided with a communication function and a signal is received, it is conceivable that it is necessary to immediately take the electronic apparatus by the hand and put the electronic apparatus to the ear and according to the invention, attachment and detachment to and from the wrist is facilitated and therefore, the invention is particularly effective in such a case.

As has been explained above, according to the wrist mounting-type electronic apparatus of the invention, engagement of the engaging means is disengaged by the push button and the strap is brought into the opened state and therefore, the wrist mounting-type electronic apparatus can promptly be disengaged from the wrist. There is a case in which the wrist mounting-type electronic apparatus is intended to promptly detach and attach from and to the wrist depending on its function such as a communication function and in such a case, the invention is extremely convenient. Further, according to the invention, the strap is formed of a hard material and therefore, the wrist mounting-type electronic apparatus is mounted to the wrist extremely easily.

Further, according to the wrist mounting-type electronic apparatus of the invention, engagement between the inserting portion and the inserted portion is disengaged by the push button, the strap is brought into the opened state and therefore, the wrist mounting-type electronic apparatus can promptly be disengaged from the wrist. There is a case in which the wrist mounting-type electronic apparatus is intended to swiftly detach and attach from and to the wrist depending on its function such as a communication function and accordingly, in such a case, the invention is extremely convenient. Further, according to the invention, the strap is formed of a hard material and accordingly, the wrist mounting-type electronic apparatus is mounted to the wrist extremely easily. Further, according to the invention, the strap is engaged by a combination of the inserting portion and the inserted portion and therefore, there is achieved an effect of capable of optically recognizing engagement easily and facilitating handling thereof.

Further, according to the wrist mounting type electronic apparatus of the invention, engagement between the inserting portion and the inserted portion is disengaged by the push button, the strap is brought into the opened state and therefore, the wrist mounting type electronic apparatus can promptly be disengaged from the wrist. There is also a case in which the wrist mounting type electronic apparatus is used in a mode of being detached and attached promptly from and to the wrist and fixed to the ear and the mouth when the wrist mounting type electronic apparatus is provided with a communication function. According to the invention, when engagement is disengaged, the straps C and D can be brought into an opening state on both sides of the main body and therefore, the straps C and D can be built with a microphone and a speaker. Thereby, from a similarity between a length around the wrist and a length between the ear and the mouth, the wrist mounting type electronic apparatus is easy to use by both modes of mounting the wrist mounting type electronic apparatus onto the wrist and putting the wrist mounting type electronic apparatus to the ear and the mouth.

Further, according to the wrist mounting type electronic apparatus of the invention, while achieving the above-described effect of the wrist mounting type electronic apparatus according to the invention, there is also achieved an effect of stabilizing the pivotal movement of the cabinet or the strap disposed on both sides of the hinge. Further, the angle of the strap is easy to lock at an angle easy to engage the strap and the strap settles excellently. Thereby, the wrist mounting type electronic apparatus is easy to attach and detach by one hand.

Further, according to the wrist mounting type electronic apparatus of the invention, engagement between the latch and the hole B is disengaged by the push button, the strap is brought into the opened state and therefore, the wrist mounting type electronic apparatus can promptly be disengaged from the wrist. Further, according to the invention, when the wrist mounting type electronic apparatus is mounted onto the wrist, the mounting member is fixed by the hole and the latch provided at the hinge and therefore, a user may simply press the strap onto the wrist with no regard of position or state of fitting. Further, when there are provided two of the straps, the respective straps can be built with a microphone and a speaker. Thereby, from a similarity between a length around the wrist and a distance between the ear and the mouth, there is constituted the wrist mounting type electronic apparatus capable of being used by both modes of mounting the wrist mounting type electronic apparatus to the wrist and putting the wrist mounting type electronic apparatus to the ear and the mouth.

Further, according to the wrist mounting type electronic apparatus of the invention, when the end portion of the bite bar on the side opposed to the projection is pushed, the strap is freely pivoted simply. The strap is urged by the spring and therefore, when the strap is pivoted freely, the strap maintains the opened state relative to the main body of the wrist mounting type electronic apparatus. Therefore, the invention achieves an effect of capable of promptly disengaging the wrist mounting type electronic apparatus from the wrist. Further, according to the invention, when the wrist mounting type electronic apparatus is mounted to the wrist, the mounting member is fixed by the groove and the bite bar provided at the hinge and therefore, a user may simply press the strap onto the wrist with no regard of position or state of biting. Further, when two of the straps are provided, the respective straps can be built with a microphone and a speaker. Thereby, from a similarity between a length around the wrist and a distance between the ear and the mouth, there is constituted the wrist mounting type electronic apparatus capable of being used by both modes of mounting the wrist mounting type electronic apparatus onto the wrist and putting the wrist mounting type electronic apparatus to the ear and the mouth.

Further, according to the wrist mounting type electronic apparatus of the invention, by pressing the push button, latch engagement between the projected portion and the recessed portion of the hinge can easily be disengaged. When the engagement is disengaged, since the hinge per se is urged in the opening direction by the spring and therefore, the strap coupled by the hinge is brought into the opened state relative to the cabinet of the main body of the wrist mounting type electronic apparatus. Therefore, the invention achieves an effect of capable of promptly disengaging the wrist mounting type electronic apparatus from the wrist. Further, according to the invention, when the wrist mounting type electronic apparatus is mounted to the wrist, the mounting member is fixed by the latch and the latch receive provided at the inner hole of the hinge and therefore, a user may simply press the strap to the wrist with no regard of a state of the latch engagement which occurs at inside thereof. Further, when two of the straps are provided, the respective straps can be built with a microphone and a speaker. Thereby, from a similarity of a length around the wrist and a distance between the ear and the mouth, there is constituted the wrist mounting type electronic apparatus capable of being used by both modes of mounting the wrist mounting type electronic apparatus to the wrist and putting the wrist mounting type electronic apparatus to the ear and the mouth.

Further, according to the wrist mounting type electronic apparatus of the invention, the latch is provided with the two face width portion at the one end portion of the cylindrical shaft and inscribed with the straight line groove at the end portion on the opposed side, the latch receive is provided with the two face width portion fitted to the straight line groove, integrated with the key groove and fitted to the inner face of the inner hole of the recessed portion and therefore, the latch can be fitted to the latch receive only when the hinge pieces constitute a desired angle relative to each other. When the position of the latch is fixed, the position of the hinge is also fixed and the position of the strap is also fixed.

When the position of the strap is fixed, the wrist mounting type electronic apparatus can be mounted to and held by the wrist. Further, fitting between the straight line groove and the two face width portion can easily be disengaged by pressing the shaft penetrating the end portion forming the two face width portion by the push button. That is, the invention achieves an effect of capable of promptly disengaging the wrist mounting type electronic apparatus from the wrist.

Further, according to the wrist mounting type electronic apparatus of the invention, the strap is opened and closed by the push button and therefore, the wrist mounting type electronic apparatus is easily attached and detached to and from the wrist. When the wrist mounting type electronic apparatus is provided with a communication function and a signal is received thereby, it is conceivable that it is necessary to take the electronic apparatus immediately by the hand and putting the electronic apparatus to the ear and according to the invention, attachment and detachment to and from the wrist is facilitated and therefore, the invention is particularly effective in such a case.

What is claimed is:

1. In combination with a portable electronic apparatus having a main body and a pair of strap members for mounting the main body to an arm of a user, a hinge assembly comprising: a pair of hinge units each for rotationally mounting respective ones of the strap members to the main body, each of the hinge units having a first hinge member integrally connected to the main body, a second hinge member integrally connected to a respective one of the strap members and connected to the first hinge member for relative pivotal movement therewith to pivot the respective one of the strap members between a locked state and an unlocked state relative to the main body, a biasing member connecting the second hinge member to the first hinge member and biasing the second hinge member in a direction of rotation toward the unlocked state of the respective one of the strap members, a latch pin mounted on one of the first hinge member and the second hinge member, and a cavity formed in the other of the first hinge member and the second hinge member for receiving therein the latch pin to place the respective one of the strap members in the locked state.

2. A combination according to claim 1; wherein the second hinge member comprises a convex portion having the bore; and wherein the first hinge member comprises a concave portion having the cavity and confronting the convex portion of the second hinge member.

3. A combination according to claim 1; therein the portable electronic apparatus can be mounted on the arm of the user in the locked state of the strap members and removed from the arm of the user in the unlocked state of the strap members.

4. A combination according to claim 1; wherein the portable electric apparatus comprises a portable communication apparatus.

5. A combination according to claim 1; further comprising a microphone and a speaker disposed in each of the strap members.

6. A combination according to claim 1; wherein the cavity is formed in the first hinge member, and the latch pin is mounted on the second hinge member.

7. A combination according to claim 6; wherein the first hinge member has a slot communicating with the cavity; and further comprising a push mechanism disposed in the slot for undergoing movement therein and into the cavity of the first hinge member to push the latch pin out of the cavity of the first hinge member so that the second hinge member is biased by the biasing member to pivot the respective one of the strap members to the unlocked state.

8. A combination according to claim 7; wherein the push mechanism comprises a button member, and a pin member connected to the button member and extending into the cavity of the first hinge member for contacting the latch pin.

9. A combination according to claim 1; wherein the cavity is formed in the first hinge member and the latch pin is movably mounted in a bore formed in the second hinge member, the bore having an open end; and further comprising a spring member disposed in the bore of the second hinge member for biasing the latch pin toward the open end of the bore.

10. A combination according to claim 9; wherein the first hinge member has a slot communicating with the cavity; and further comprising a push mechanism disposed in the slot for undergoing movement therein and into the cavity of the first hinge member to push the latch pin out of the cavity of the first hinge member against the bias of the spring member disposed in the bore of the second hinge member so that the second hinge member is biased by the biasing member to pivot the respective one of the strap member to the unlocked state.

11. A combination according to claim 10; wherein the push mechanism comprises a button member, and a pin member connected to the button member and extending into the cavity of the first hinge member for contacting the latch pin.

12. In combination with a portable electronic apparatus having a main body and at least one strap member for mounting the main body to an arm of a user, a hinge assembly comprising:

a first hinge member integrally connected to the main body;

a second hinge member integrally connected to the strap member and connected to the first hinge member for relative pivotal movement therewith to pivot the strap member between a locked state and an unlocked state relative to the main body;

a biasing member connecting the second hinge member to the first hinge member and biasing the second hinge member in a direction of rotation toward the unlocked state of the strap member;

a latch pin mounted on one of the first hinge member and the second hinge member; and a cavity formed in the other of the first hinge member and the second hinge member for receiving therein the latch pin to place the strap member in the locked state relative to the main body.

13. A combination according to claim 12; wherein the second hinge member comprises a convex portion having the bore; and wherein the first hinge member comprises a concave portion having the cavity and confronting the convex portion of the second hinge member.

14. A combination according to claim 12; wherein the portable electronic apparatus can be mounted on the arm of the user in the locked state of the band and removed from the arm of the user in the unlocked state of the band.

15. A combination according to claim 12; wherein the portable electric apparatus comprises a portable communication apparatus.

16. A combination according to claim 12; further comprising a microphone and a speaker disposed in the band.

17. A combination according to claim 12; wherein the cavity is formed in the first hinge member, and the latch pin is mounted on the second hinge member.

18. A combination according to claim 17; wherein the first hinge member has a slot communicating with the cavity; and further comprising a push mechanism disposed in the slot for undergoing movement therein and into the cavity of the first hinge member to push the latch pin out of the cavity of the first hinge member so that the second hinge member is biased by the biasing member to pivot the strap member to the unlocked state.

19. A combination according to claim 18; wherein the push mechanism comprises a button member, and a pin member connected to the button member and extending into the cavity of the first hinge member for contacting the latch pin.

20. A combination according to claim 12; wherein the cavity is formed in the first hinge member and the latch pin is movably mounted in a bore formed in the second hinge member, the bore having an open end; and further comprising a spring member disposed in the bore of the second hinge member for biasing the latch pin toward the open end of the bore.

21. A combination according to claim 20; wherein the first hinge member has a slot communicating with the cavity; and further comprising a push mechanism disposed in the slot for undergoing movement therein and into the cavity of the first hinge member to push the latch pin out of the cavity of the first hinge member against the bias of the spring member disposed in the bore of the second hinge member so that the second hinge member is biased by the biasing member to pivot the strap member to the unlocked state.

22. A combination according to claim 21; wherein the push mechanism comprises a button member, and a pin member connected to the button member and extending into the cavity of the first hinge member for contacting the latch pin.

23. A hinge assembly for rotationally mounting a rotational member to a body member, the hinge assembly comprising:

a first hinge member securable in use of the hinge assembly to a body member, the first hinge member having a peripheral surface, a slot formed in the peripheral surface, and a cavity formed in the peripheral surface and disposed in communication with the slot;

a second hinge member securable in use of the hinge assembly to a rotational member for rotation therewith between a locked state and an unlocked state of the rotational member relative to the body member, the second hinge member having a peripheral surface and a bore having an open end and formed in the peripheral surface;

a first biasing member connecting the second hinge member to the first hinge member and biasing the second hinge member and the rotational member in a direction of rotation towards the unlocked state of the rotational member;

a latch pin movably mounted in the bore of the second hinge member;

a second biasing member disposed in the bore of the second hinge member for biasing an end portion of the latch out of the open end of the bore and into the cavity of the first hinge member to place the rotational member in the locked state; and a push mechanism disposed in the slot of the first hinge member for undergoing movement therein and into the cavity of the first hinge member to push the latch pin out of the cavity of the first hinge member when the rotational member is in the locked state so that the rotational member is biased by the first biasing member towards the unlocked state.

24. A hinge assembly according to claim 23; wherein the push mechanism comprises a button member, and a pin member connected to the button member and extending into the cavity of the first hinge member for contacting the latch pin.

25. A hinge assembly according to claim 23; wherein the rotational member is formed of a hard material.

26. A hinge assembly according to claim 23; wherein the second hinge member comprises a convex portion having the bore; and wherein the first hinge member comprises a concave portion having the cavity and confronting the convex portion of the second hinge member.

27. A hinge assembly comprising:

a first hinge member;

a second hinge member mounted to undergo rotational movement between a locked state and an unlocked state relative to the first hinge member;

a biasing member connecting the second hinge member to the first hinge member and biasing the second hinge member in a direction of rotation toward the unlocked state of the second hinge member;

a latch pin movably mounted in a bore formed in the second hinge member, the bore having an open end;

a biasing member disposed in the bore of the second hinge member for biasing the latch pin toward the open end of the bore; and a cavity formed in the first hinge member for receiving therein the latch pin to place the second hinge member in the locked state.

28. A hinge assembly according to claim 27; wherein the first hinge member has a slot communicating with the cavity; and further comprising a push mechanism disposed in the slot for undergoing movement therein and into the cavity of the first hinge member to push the latch pin out of the cavity of the first hinge member against the bias of the biasing member disposed in the bore of the second hinge member so that the second hinge member is biased by the biasing member toward the unlocked state.

29. A hinge assembly according to claim 28; wherein the push mechanism comprises a button member, and a pin member connected to the button member and extending into the cavity of the first hinge member for contacting the latch pin.

30. A hinge assembly comprising:

a first hinge member having a slot therein;

a second hinge member mounted to undergo rotational movement between a locked state and an unlocked state relative to the first hinge member;

a biasing member connecting the second hinge member to the first hinge member and biasing the second hinge member in a direction of rotation toward the unlocked state of the second hinge member;

a latch pin mounted on the second hinge member;

a cavity formed in the first hinge member for receiving therein the latch pin to place the second hinge member in the locked state, the cavity communicating with the slot in the first hinge member; and a push mechanism disposed in the slot for undergoing movement therein and into the cavity of the first hinge member to push the latch pin out of the cavity of the first hinge member so that the second hinge member is biased by the biasing member toward the unlocked state.

31. A hinge assembly according to claim 30; wherein the push mechanism comprises a button member, and a pin member connected to the button member and extending into the cavity of the first hinge member for contacting the latch pin.

* * * * *